US008816923B2

(12) United States Patent
King et al.

(10) Patent No.: US 8,816,923 B2
(45) **Date of Patent: *Aug. 26, 2014**

(54) MOTORIZED SATELLITE TELEVISION ANTENNA SYSTEM

(75) Inventors: Lael King, Minneapolis, MN (US); Sam Shuster, Minneapolis, MN (US)

(73) Assignee: Electronic Controlled Systems, Inc., Bloomington, MN (US)

( * ) Notice: Subject to any disclaimer, the term of this patent is extended or adjusted under 35 U.S.C. 154(b) by 506 days.

This patent is subject to a terminal disclaimer.

(21) Appl. No.: 12/495,348

(22) Filed: Jun. 30, 2009

(65) Prior Publication Data

US 2009/0262033 A1 Oct. 22, 2009

Related U.S. Application Data

(63) Continuation-in-part of application No. 11/960,657, filed on Dec. 19, 2007, now Pat. No. 7,595,764.

(60) Provisional application No. 60/888,673, filed on Feb. 7, 2007.

(51) Int. Cl.
*H01Q 3/00* (2006.01)

(52) U.S. Cl.
USPC ..... 343/766

(58) Field of Classification Search
USPC ..... 343/765–766, 757; 342/75–76, 352
See application file for complete search history.

(56) References Cited

U.S. PATENT DOCUMENTS

| | | | |
|---|---|---|---|
| 2,814,038 | A | 11/1957 | Miller |
| 3,071,338 | A | 1/1963 | Kaufman et al. |
| 3,388,401 | A | 6/1968 | Weir |
| 3,599,218 | A | 8/1971 | Williamson et al. |
| 3,781,898 | A | 12/1973 | Holloway et al. |
| 3,918,065 | A | 11/1975 | Hutchinson et al. |
| 4,096,481 | A | 6/1978 | Widmer et al. |
| 4,190,839 | A | 2/1980 | Liautaud |

(Continued)

FOREIGN PATENT DOCUMENTS

| | | | |
|---|---|---|---|
| FR | 2589633 | A1 | 5/1987 |
| JP | 2005-203978 | A | 7/2005 |
| WO | WO 2008/098121 | A1 | 8/2008 |

OTHER PUBLICATIONS

Search Report and Written Opinion for WO 2008/098121 A1, dated Jun. 25, 2008, 8 pages.

(Continued)

*Primary Examiner* — Huedung Mancuso
(74) *Attorney, Agent, or Firm* — Skaar Ulbrich Macari, P.A.

(57) ABSTRACT

A bracket for releasably mounting an enclosed mobile/transportable motorized antenna system on a vehicle may include a support arm and a mounting assembly. The support arm can include a first end portion configured to secure to a vertically extending member of a vehicle and a second end portion configured to secure a mounting plate assembly. The mounting assembly can be secured to the second end portion of the support arm. The mounting assembly may comprise a generally planar mounting plate having a plurality of apertures defined therein. The apertures may be located within the periphery of the mounting plate and have a size and shape configured to secure a motorized antenna enclosure disposed on the mounting plate assembly. A releasably mountable enclosed mobile/transportable motorized antenna system on a vehicle may include an enclosed mobile/transportable motorized antenna system and a corresponding mounting bracket.

18 Claims, 26 Drawing Sheets

(56) References Cited

U.S. PATENT DOCUMENTS

| | | | | |
|---|---|---|---|---|
| 4,282,530 | A | 8/1981 | Semplak | |
| 4,309,708 | A | 1/1982 | Sayovitz | |
| 4,649,675 | A | 3/1987 | Moldovan et al. | |
| 4,654,670 | A | 3/1987 | Fleming | |
| 4,771,293 | A | 9/1988 | Williams et al. | |
| 4,868,575 | A | 9/1989 | Mok et al. | |
| 4,918,459 | A | 4/1990 | De Teso | |
| 4,939,524 | A | 7/1990 | Blaese | |
| 4,946,736 | A | 8/1990 | Sassa | |
| 4,998,114 | A | 3/1991 | Eto et al. | |
| 5,019,833 | A | 5/1991 | Nonaka | |
| 5,088,680 | A | 2/1992 | Farmer | |
| D333,470 | S | 2/1993 | Vong | |
| 5,218,369 | A | 6/1993 | Jennings | |
| 5,274,382 | A | 12/1993 | Wills et al. | |
| 5,296,862 | A | 3/1994 | Rodeffer et al. | |
| 5,309,162 | A | 5/1994 | Uematsu et al. | |
| 5,337,062 | A | 8/1994 | Sherwood et al. | |
| 5,347,286 | A | 9/1994 | Babitch | |
| 5,418,542 | A | 5/1995 | Sherwood et al. | |
| 5,419,521 | A | 5/1995 | Matthews | |
| 5,451,972 | A | 9/1995 | Franklin | |
| 5,471,219 | A | 11/1995 | Rodeffer et al. | |
| D364,874 | S | 12/1995 | Cheng | |
| 5,515,065 | A | 5/1996 | Sherwood et al. | |
| 5,528,253 | A | 6/1996 | Franklin | |
| 5,543,814 | A | 8/1996 | Jenness, Jr. | |
| 5,585,804 | A | 12/1996 | Rodeffer | |
| 5,619,215 | A | 4/1997 | Sydor | |
| 5,646,638 | A | 7/1997 | Winegard et al. | |
| 5,675,348 | A | 10/1997 | Okada et al. | |
| 5,689,276 | A | 11/1997 | Uematsu et al. | |
| 5,714,963 | A | 2/1998 | Cox | |
| 5,729,241 | A | 3/1998 | Ergen et al. | |
| 5,760,751 | A | 6/1998 | Gipson | |
| 5,815,125 | A | 9/1998 | Kelly et al. | |
| 5,819,185 | A | 10/1998 | Umezawa et al. | |
| 5,877,730 | A | 3/1999 | Foster | |
| 5,892,488 | A | 4/1999 | Dulon | |
| 5,949,386 | A | 9/1999 | Elliott | |
| 5,983,071 | A | 11/1999 | Gagnon et al. | |
| 6,023,245 | A | 2/2000 | Gomez et al. | |
| 6,072,440 | A | 6/2000 | Bowman | |
| 6,175,171 | B1 | 1/2001 | Rupp et al. | |
| 6,188,367 | B1 | 2/2001 | Morrison et al. | |
| 6,191,752 | B1 | 2/2001 | Lester et al. | |
| 6,191,753 | B1 | 2/2001 | Ellis et al. | |
| 6,191,820 | B1 | 2/2001 | Kang et al. | |
| 6,204,820 | B1 | 3/2001 | Jensen, Jr. | |
| D440,961 | S | 4/2001 | Inoue | |
| D440,965 | S | 4/2001 | Inoue | |
| D442,167 | S | 5/2001 | Emery | |
| 6,266,017 | B1 | 7/2001 | Aldous | |
| 6,285,338 | B1 * | 9/2001 | Bai et al. | 343/882 |
| 6,292,155 | B1 | 9/2001 | McPhilmy et al. | |
| 6,300,893 | B1 * | 10/2001 | Schaff et al. | 342/10 |
| D468,302 | S | 1/2003 | Sato | |
| 6,512,490 | B1 | 1/2003 | Lee | |
| D470,131 | S | 2/2003 | Noro et al. | |
| 6,531,990 | B2 | 3/2003 | Verkerk | |
| 6,538,612 | B1 | 3/2003 | King | |
| D480,712 | S | 10/2003 | Noro | |
| 6,682,029 | B1 | 1/2004 | Dierkes | |
| 6,693,587 | B1 | 2/2004 | Kuether et al. | |
| 6,710,749 | B2 | 3/2004 | King | |
| 6,710,794 | B1 | 3/2004 | Yamazaki et al. | |
| 6,714,167 | B1 | 3/2004 | Gusick, Jr. | |
| 6,762,727 | B2 | 7/2004 | Rochford et al. | |
| 6,844,855 | B2 | 1/2005 | Carson | |
| 6,864,846 | B2 | 3/2005 | King | |
| 6,937,199 | B2 | 8/2005 | King | |
| 7,227,506 | B1 | 6/2007 | Lewis, Jr. | |
| 7,230,581 | B2 | 6/2007 | McEwan | |
| 7,268,734 | B2 | 9/2007 | Cislo | |
| 7,372,428 | B1 | 5/2008 | King | |
| 7,595,764 | B2 * | 9/2009 | Shuster et al. | 343/766 |
| 7,764,243 | B2 * | 7/2010 | Gierow et al. | 343/766 |
| 2004/0080461 | A1 | 4/2004 | Rothgeb et al. | |
| 2004/0181810 | A1 * | 9/2004 | Pelkey et al. | 725/116 |
| 2005/0225495 | A1 | 10/2005 | King | |
| 2007/0007402 | A1 | 1/2007 | Dierkes | |
| 2007/0252765 | A1 | 11/2007 | Jayasuriya et al. | |
| 2008/0136722 | A1 | 6/2008 | King | |
| 2008/0246677 | A1 | 10/2008 | King | |
| 2009/0040130 | A1 | 2/2009 | Conrad | |
| 2009/0085825 | A1 | 4/2009 | Conrad | |
| 2009/0085826 | A1 | 4/2009 | Conrad | |

OTHER PUBLICATIONS

KVH Industries, Inc., A Guide to TracVision LM, 1999, 49 pages.
KVH Industries, Inc., A Guide to TracVision L3/S3—Owner's Manual, 2003, 77 pages.
KVH Industries, Inc., A Guide to TracVision G4—Owner's Manual, 1999, 133 pages.
KVH Industries, Inc., A Guide to TracVision R4/R5—Owner's Manual, 2005, 66 pages.
KVH Industries, Inc., TracVision 45 manual, 1998, 47 pages.
Datron/Transco Inc. brochure, Product Information sheet for DBS-3000 Mobile Satellite Television System, Dec. 1996, 2 pages.
Datron/Transco Inc. Installation Instructions for DBS-30500 Mobile Satellite Television System, 1999, 23 pages.
Datron/Transco Inc., News Release dated Jul. 17, 1996 with information sheet for DBS-4000 In-Motionj Satellite System, 3 pages.
Datron/Transco Inc. Installation Instructions for DBS-4000-100 In-Motion Satellite Television System, 1996, 24 pages.
Datron/Transco Inc. product Information sheet for DBS-4000 In-Motion Digital Satellite Television Reception System, undated, 2 pages.
Sea Tel Inc., Operation and Installation Manual for Sea Tel Model 1898 Shipboard Satellite TV System, Oct. 2001, 51 pages.
Sea Tel Inc., Installation and Operation Manual for Sea Tel Model 2094 Shipboard Satellite TV Receive-Only System, May 1996, 81 pages.
Sea Tel Inc., Installation and Operation Manual for Sea Tel Model Coastal 18 Satellite TV Receive-Only Antenna with Motorized Polarization, Feb. 23, 2006, 88 pages.
King Controls Brochure for King Dome Automatic Satellite System, 1998, 2 pages.
King Controls, Installation and Operating Instructions manual for 9702 and 9702L-LP Automatic Satellite System, undated, 18 pages.
King Dome Satellite Locator System product informaiton, Mar. 5, 1999, 47 pages.
Telemetry & Communications Systems, Inc., Model 600 Portable Antenna System, Sep. 2003, 2 pages.
Winegard Co., Installation/Operation manual for RoadTrip LP1000 Satellite System, Jul. 20, 2004, 20 pages.
Winegard Co., manual for Movin View Digital Satellite Mobile Antenna for Two Receivers Model MV3500A, May 2005, 12 pages.
Rulings on Post-Trial Motions in the case in Case # 3:09-cv-00138-CRW-CFB (S.D. Iowa), Mar. 7, 2012, 12 pages.
Federal Circuit Decision for Appeal No. 2012-1282 (regarding case in Case # 3:09-cv-00138-CRW-CFB (S.D. Iowa), Nov. 16, 2012, 2 pages.
Patent Trial and Appeals Board decision in Inter-partes Reexamination No. 95/000559 (re US 7595764), Nov. 27, 2012, 20 pages.
Patent Trial and Appeals Board decision in Inter-partes Reexamination No. 95/000560 (re US 7679573), Nov. 27, 2012, 21 pages.
Patent Trial and Appeals Board Decision of Request for Rehearing in Inter-partes Reexamination No. 95/000560, Mar. 7, 2013, 15 pages.

* cited by examiner

MOTORIZED SATELLITE TELEVISION ANTENNA SYSTEM

The present application is a continuation-in-part of U.S. application Ser. No. 11/960,657, filed Dec. 19, 2007, which claims priority benefit of U.S. Provisional Application No. 60/888,673, filed Feb. 7, 2007. Both of these applications are hereby incorporated by reference in their entirety.

FIELD OF THE INVENTION

The present invention relates to portable motorized antenna systems. More particularly, the present invention relates to mounting hardware adapted to releasably mount on a vehicle an enclosed mobile motorized antenna system that is easily manually transportable.

BACKGROUND OF THE INVENTION

The current state of the art and practice for enclosed, environmentally protected mobile satellite radome antenna systems receiving signals for digital television, such as Ku-band and Ka-band signals, and digital radio is to mount the antenna to the roof or top, flat surface of a vehicle or other structure. Typically, these satellite antenna systems are mounted to a top surface, directly or with a bracket, and have one or more wire harnesses to communicate between a remote, an external radome antenna to control antenna position and signal acquisition, and a wire harness dedicated for power. The radomes themselves—the enclosure housing the antenna and peripheral devices—for mounted mobile satellite systems are generally spherical with the base having a similar or larger diameter than the cover at its widest point and a flat bottom.

This current configuration used for such systems limits their use on structures and vehicles without a flat roof or flat mounting surface or higher profile vehicles like tractor-trailer trucks. When mounted at an angle (or not flat), current designs for mobile satellite antennas will lose dynamic range. Moreover, the spherical shape and large base footprint make mounting to a flat side of a structure cumbersome and, in the case of some vehicles, such as tractor trailers, unsafe because of the limited space between the truck and trailer. Such systems also typically must be mounted in a manner in which they are not easily removable, which limits the versatility of the system and can require permanent alterations to the structure. In addition, the multiple wires needed to connect components inside the structure with components outside the structure can be cumbersome and make installation difficult. The geometry of such systems also makes them difficult and awkward to transport from place to place.

Some satellite systems are equipped with handles to allow the systems to be carried to new locations. Such systems typically fold into a suitcase-like configuration for transportation. However, because such systems fold-up to be carried, time must be taken to set the system up for use once it has been transported to a desired location.

SUMMARY OF THE INVENTION

The present disclosure is directed to hardware for releasably mounting an enclosed mobile/transportable motorized antenna system on a vehicle. In one example embodiment, a mounting bracket can include a support arm and a mounting assembly. The support arm can include a first end portion configured to secure to a vertically extending member of a vehicle and a second end portion configured to secure a mounting plate assembly. The mounting assembly can be secured to the second end portion of the support arm. The mounting assembly may comprise a generally planar mounting plate having a plurality of apertures defined therein. The apertures may be located within the periphery of the mounting plate and have a size and shape configured to secure a motorized antenna enclosure disposed on the mounting plate assembly.

In another example embodiment, an enclosed mobile/transportable motorized antenna system releasably mountable on a vehicle may comprise a motorized antenna and a corresponding mounting bracket. The motorized antenna system may comprise a generally rigid enclosure comprised of an electromagnetic wave permeable material defining a volume configured to enable both manual transportability of the motorized antenna system and automated operation of the motorized antenna system without a substantial change in the volume of the enclosure or manual repositioning of the motorized antenna system. The mounting bracket may comprise a mounting portion configured to secure the portable motorized antenna system to a vehicle and a platform portion configured to non-permanently mount the motorized antenna system.

In a further embodiment, a method of removably mounting a portable motorized antenna system on a vehicle may comprise securing the first end of a mounting bracket to a generally vertically oriented portion of a vehicle, placing a portable motorized antenna system on a mounting plate on a second end of the mounting bracket and securing the portable motorized antenna system to the mounting bracket.

DETAILED DESCRIPTION OF THE PREFERRED EMBODIMENTS

Figure 1:
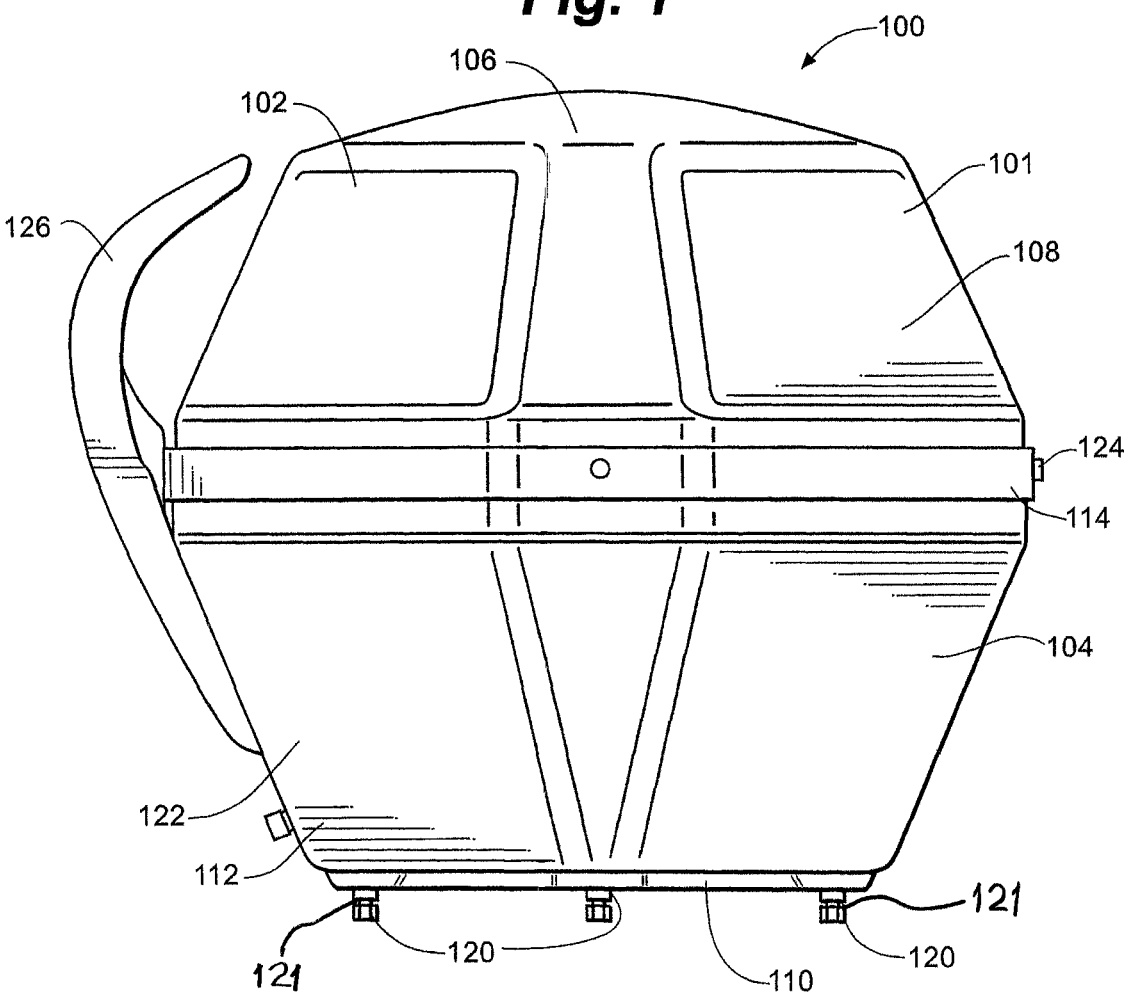
FIG. 1 is an enclosed mobile satellite antenna system according to one example embodiment.
Figure 2:
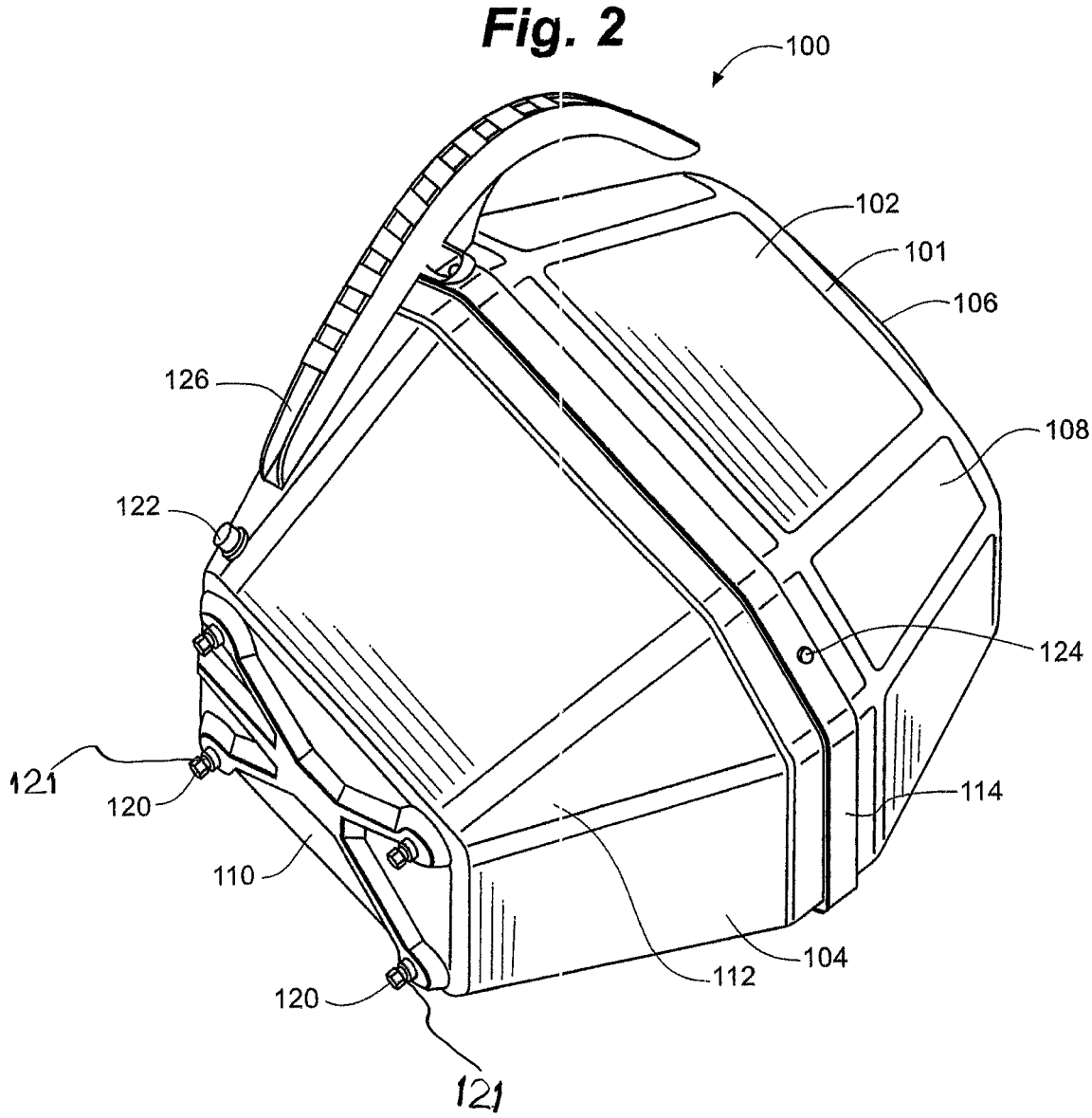
FIG. 2 is an enclosed mobile satellite antenna system according to one example embodiment.
Figure 3:
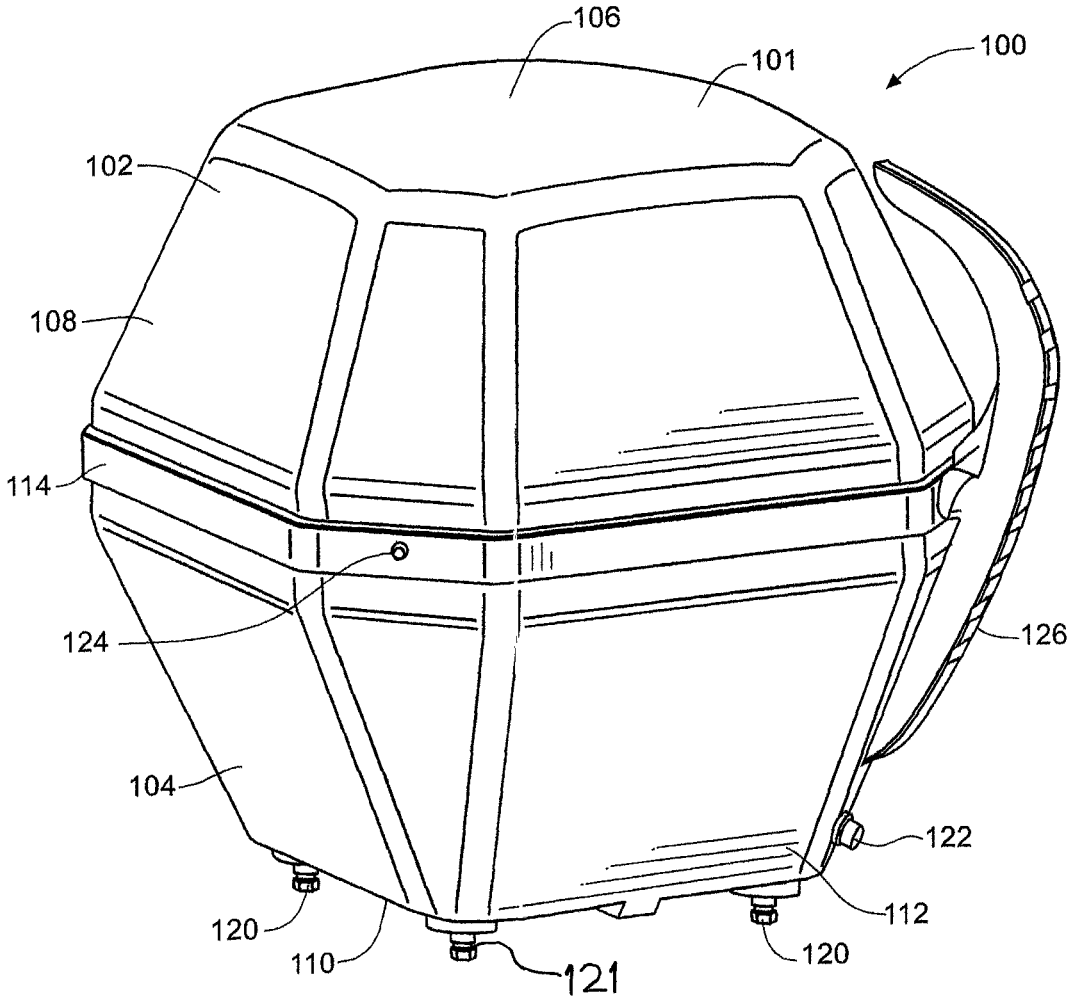
FIG. 3 is an enclosed mobile satellite antenna system according to one example embodiment.
Figure 4:
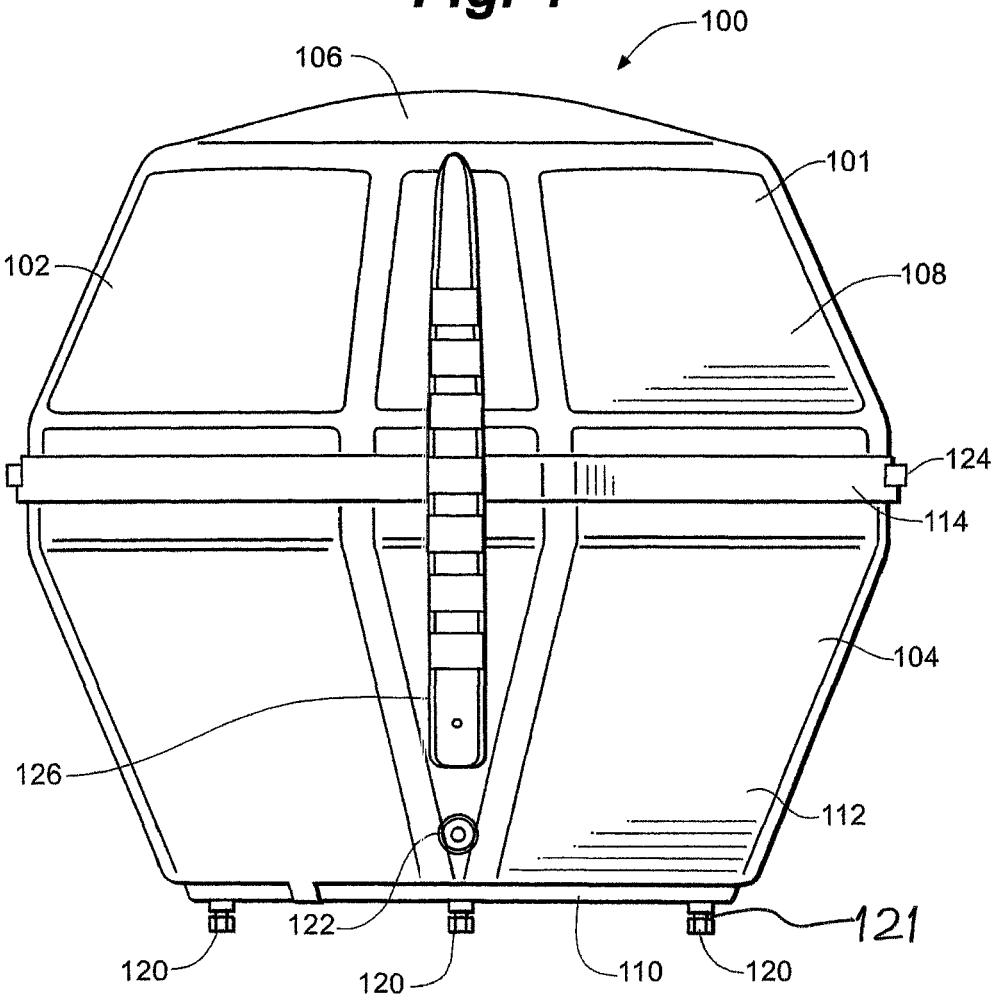
FIG. 4 is an enclosed mobile satellite antenna system according to one example embodiment.

Referring to FIGS. 1-4, there can be seen an enclosed mobile satellite antenna system 100 according to an example embodiment of the present invention. Enclosed mobile satellite antenna system 100 includes an enclosure 101 with a satellite antenna system therein for acquiring and receiving a satellite signal. However, other types of antennas can alternatively be provided within the enclosure 101, for example, antennas used to receive broadcasts from terrestrial transmitters, such as for television, wireless phones, WiFi (WiMAX) and radio.

Enclosure 101 includes a cover 102 and a base 104. Enclosure 101 is dielectric and is preferably made out of a ultraviolet protected lightweight plastic or other electromagnetic wave permeable material. Enclosure 101 is environmentally protected to prevent satellite antenna and related structure contained therein, such as one or more antenna positioning motors, antenna positioning control electronics, a satellite signal collecting and amplifying device, and ancillary electronics and devices to provide feedback to a user regarding the satellite antenna system and signal acquisition function and status, from becoming damaged by the outside environment.

In one embodiment, cover 102 can include a top surface 106 and a plurality of flat, angled side surfaces 108. Top surface 106 can be flat or slightly curved. Angled side surfaces 108 diverge at an angle greater than 90 degrees relative to top surface 106. The inner surface of the top surface 106 of cover 102 can be concave in order to reduce signal loss caused by standing water on the top surface 106 of the enclosure.

In one embodiment, base 104 can include a flat bottom surface 110 and a plurality of flat, angled side surfaces 112. Angled side surfaces 112 of base 104 diverge at an angle greater than 90 degrees relative to bottom surface 110. Base 104 preferably has a footprint small enough to fit on current brackets commonly found on the back of long-haul trucks for logistical communication hardware. The use of such existing brackets to mount an enclosed mobile satellite antenna system 100 results in cost savings and easier installation. Base 104 can further include a plurality of protrusions or feet 120 on which enclosure 101 can rest to prevent damage to bottom surface 110. Base 104 can also include a coaxial connector 122 to which a cable can be connected for powering and/or receiving signals from or sending signals to the satellite antenna system contained inside the enclosure 101. Connector 122 can protrude out of one of the angled side surfaces 112 or out of bottom surface 110.

The feet 120 can have a notch, groove, inset or slot 121 defined in an exterior surface. The notch, groove, inset or slot 121 can also be provided by inserting a foot into the enclosure that has two different widths or diameters. In the latter embodiment, the larger width is located farthest from the enclosure. The enclosure has a receiving portion that is wider or has a larger diameter than the narrower portion of the foot. The notch, groove, inset or slot 121 can further be provided by disposing or forming a flange on an outer portion of a foot.

The notch, groove, inset or slot 121 can be used to secure the enclosure 101 in a base or a mounting bracket. The notch, groove, inset or slot 121 may circumscribe the entire sidewall perimeter of the feet. Alternatively, the feet may have dissimilar notches, grooves, insets or slots in one or more feet to facilitate registration of the enclosure on a mounting means. The enclosure can have any number of feet.

In one embodiment, cover 102 and base 104 can be generally symmetrical with each other in size and shape. Cover 102 and base 104 can be engaged to one another with screws 124. Where cover 102 and base 104 meet, a flat surface 114 can be formed that is generally perpendicular to top surface 106 and/or bottom surface 110. This flat surface 114 can be abutted directly adjacent the side of a vehicle or other structure to minimize the distance that the satellite antenna system and enclosure protrude from the structure, with respect to traditional roof-mounted domed systems. A handle 126 can be affixed to cover 102 and/or base 104 for easy transportation of enclosure 101.

The geometry of the enclosure 101, including the angled side surfaces 108, 112 and concave inner surface of top surface 106, allows a parabolic dish contained therein to have a large surface area relative to the volume of the enclosure. In one embodiment, an enclosure 101 having a volume of 2,615 cubic inches can contain a satellite antenna having a parabolic dish having a surface area of 177.19 square inches. This yields a ration of cubic volume to dish area of about 14.76 to 1. In another embodiment, the enclosure 101 can be 17.5 inches tall and up 16 inches wide, resulting in an enclosure volume of less than 3360 cubic inches. A smaller enclosure 101 also weighs less, which eases installation, minimizes damage to the satellite antenna components caused by movement and vibration, and increases portability for non-permanently mounted enclosures. In one embodiment, the enclosure 101 can have a smaller base bottom surface 110 than the diameter of the dish contained therein. The center of mass of the system in this configuration is positioned such that the enclosure does not tip over when rested on bottom surface. In addition, the angled sides lessen the effects of signal loss caused by moisture or condensation such as dew, rain, sleet, or snow (rain fade).

An enclosed mobile satellite antenna system according to the present invention can be mounted in the standard fashion on a flat top surface of a vehicle and can also be mounted on either the side or the rear of a vehicle. Examples of such vehicles include long-haul trucks, vans, SUVs, trailers, motor homes, and boats. Enclosed mobile satellite antenna system can also be mounted on other structures. Such structures include buildings, fences, railings, and poles.

Enclosed mobile satellite antenna system can be mounted to a vehicle or other structure with a mounting means, such as a bracket or a docking station, in either a permanent or a non-permanent manner. The system can be placed on top of or nested into a mounting means and can rest upon or attach to the mounting means. The antenna system can be attached to a mounting means by various means, such as, for example, nuts and bolts, suction cups, clips, snaps or a pressure fit. Mounting means can include an anti-theft mechanism such as a lock or an alarm triggered by the removal of the system from the mounting means. In one embodiment, mounting means can be provided with an anti-theft mechanism whereby when a tilt sensor, for example, experiences a large level change (thereby indicating it has been removed from the mounting means), it sets off an alarm. In another embodiment, the satellite antenna system can be provided with an anti-theft mechanism in or on the enclosure whereby when a tilt sensor, for example, experiences a large level change (thereby indicating the enclosure has been moved), it sets off an alarm.

A mounting means can be attached to a vehicle or other structure permanently or semi-permanently. The components of a mounting means can be made out of a variety of materials such as, for example, aluminum, steel, plastic, rubber, or some combination of materials. Mounting means can attach to a structure by various means, including nuts and bolts, tape, glue, suction cups, clips, or snaps. The mounting means components can be constructed in such a way as to allow any wire connections between the outside of a structure and the inside of the structure to be directly connected, to connect by passing through the mounting means, or to connect by plugging directly into the mounting means.

In one embodiment, the bracket components can be attached to a window. Any necessary wiring between the enclosed mobile satellite antenna system and the inside of the vehicle or other structure can be passed through the window while it is open. The bracket components can then be secured in place by rolling up or otherwise partially closing the window. In other embodiments, the bracket can be hung on a ladder secured to the vehicle or other structure or on any other surface that the bracket components can hook to, such as side mirrors or yokes. Any necessary wiring can be passed through the nearest opening in the structure to connect the enclosed mobile satellite antenna system with the interior of the structure. Brackets can be designed to allow flat side surfaces of enclosed mobile satellite antenna system to mount flushly, for example within about a half-inch away from touching the structure. This increases safety by providing for less overhang of the system from the structure. In the case of vehicles such as long haul trucks, flush mounting or near flush mounting maximizes the distance between truck and trailer, which allows the system to be used on a greater variety of vehicles.

Figure 5:
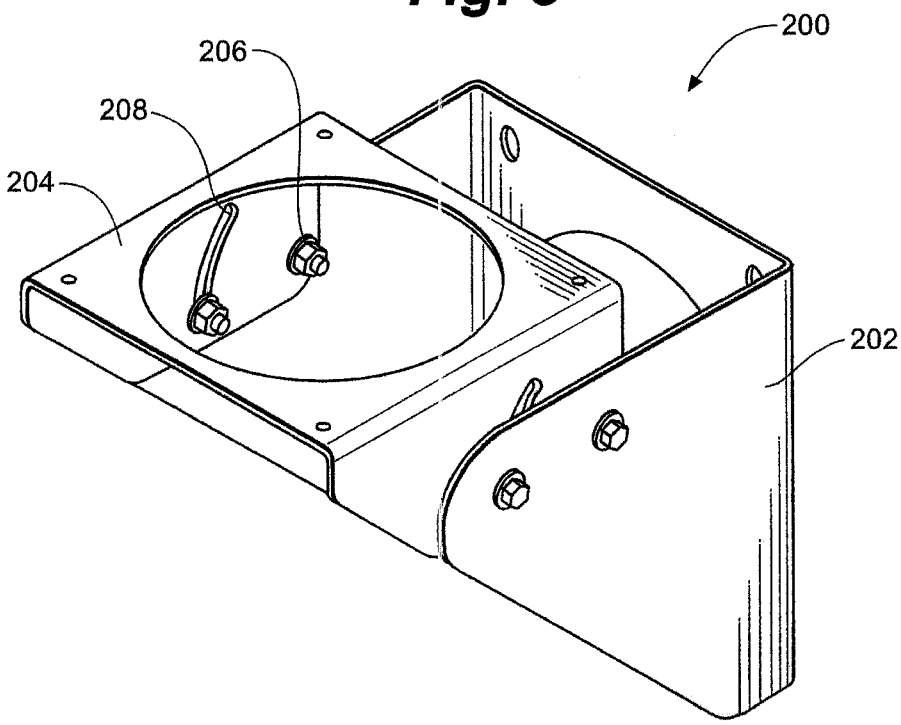
FIG. 5 is a mounting means for an enclosed mobile satellite antenna system according to one example embodiment.
Figure 6:
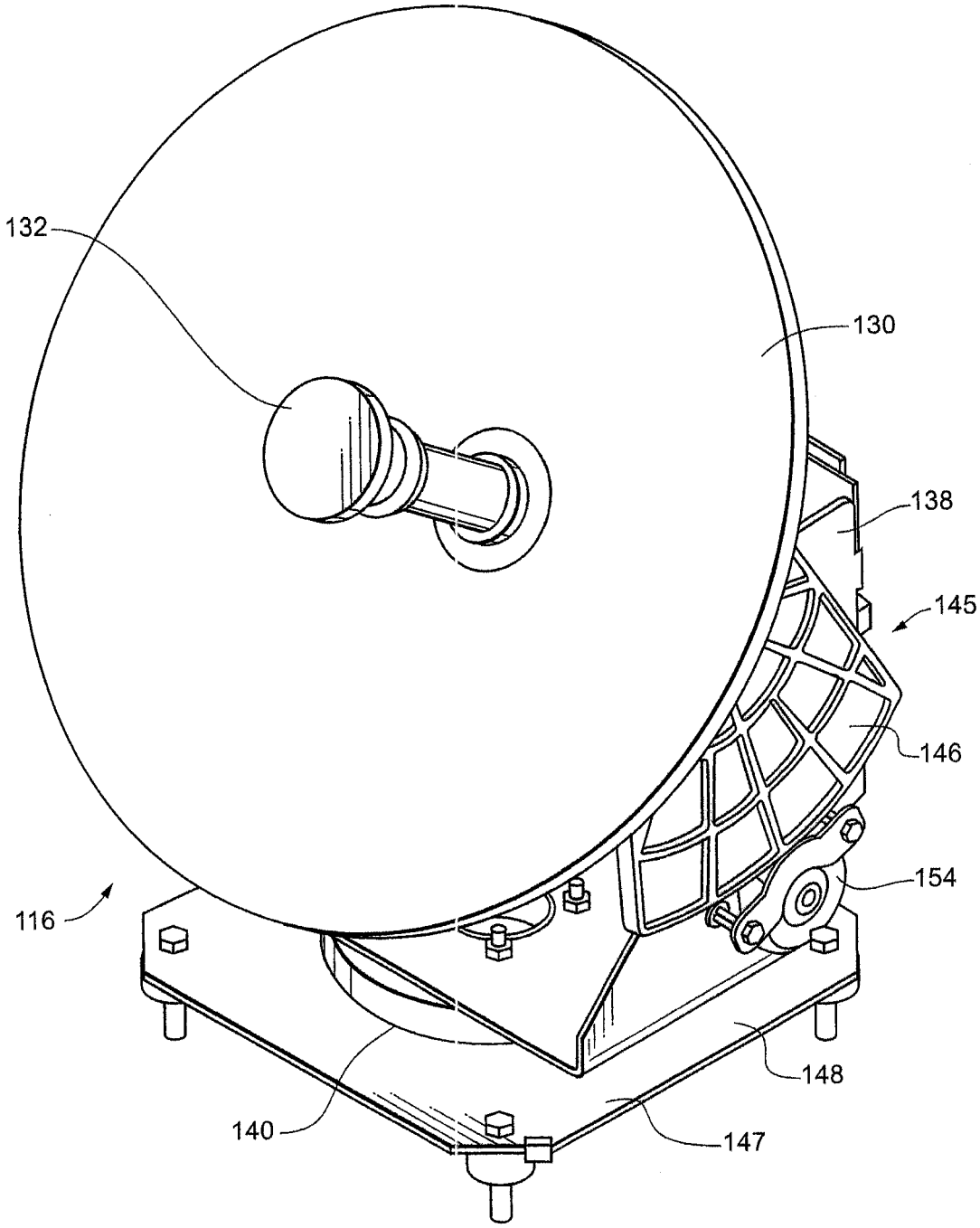
FIG. 6 is a satellite antenna system for an enclosed mobile satellite antenna system according to one example embodiment.
Figure 7:
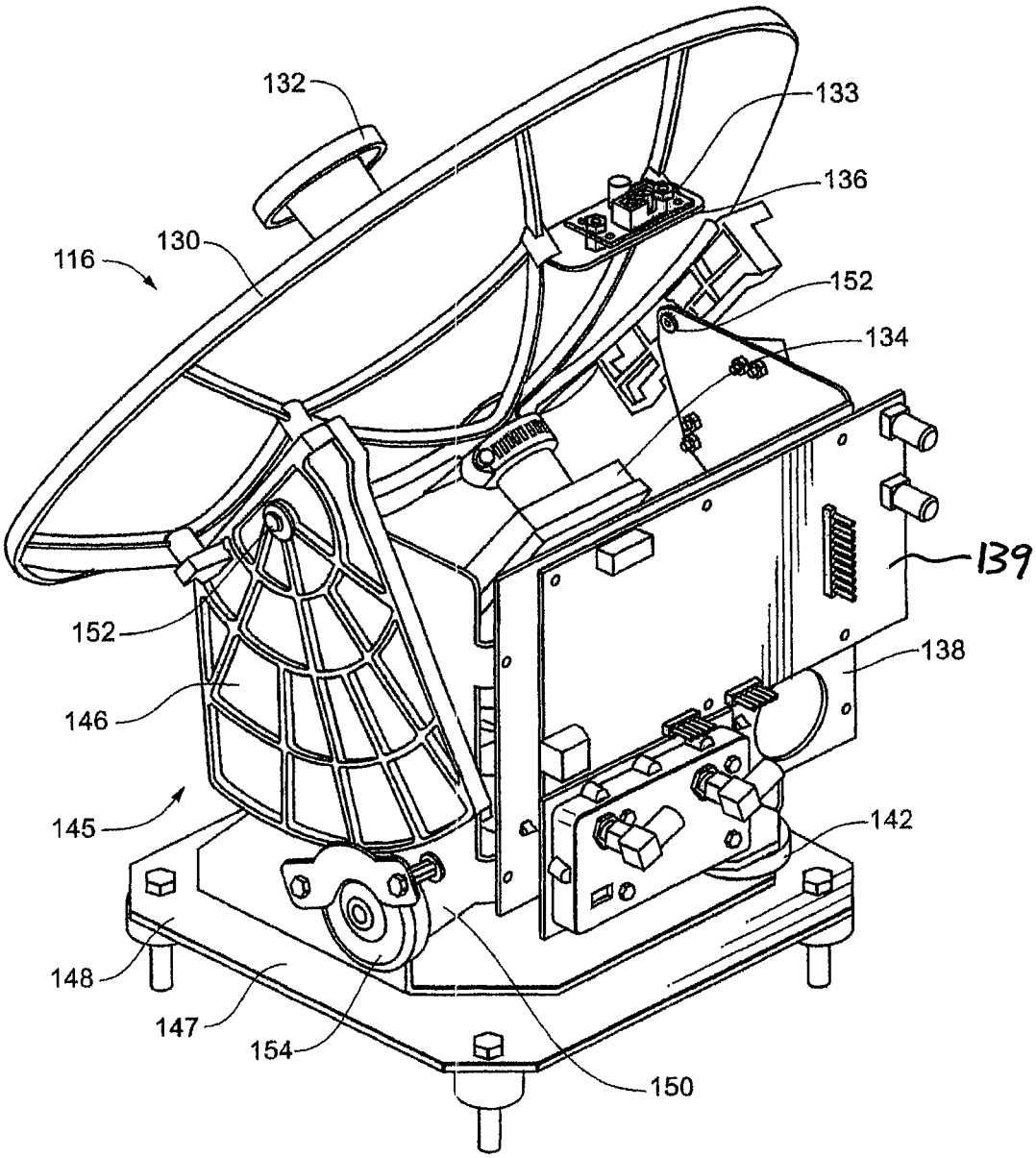
FIG. 7 is a satellite antenna system for an enclosed mobile satellite antenna system according to one example embodiment.
Figure 8:
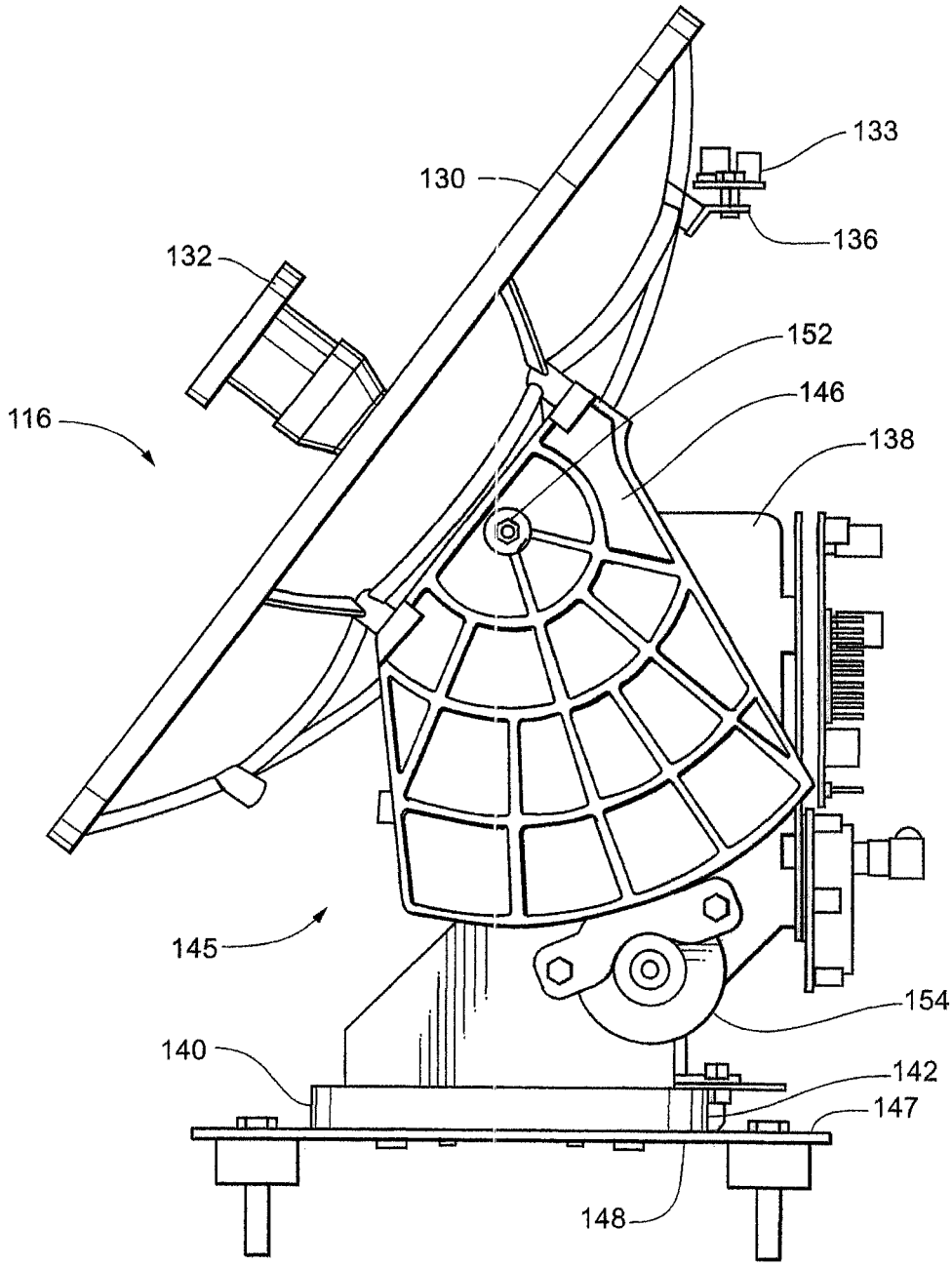
FIG. 8 is a satellite antenna system for an enclosed mobile satellite antenna system according to one example embodiment.
Figure 9:
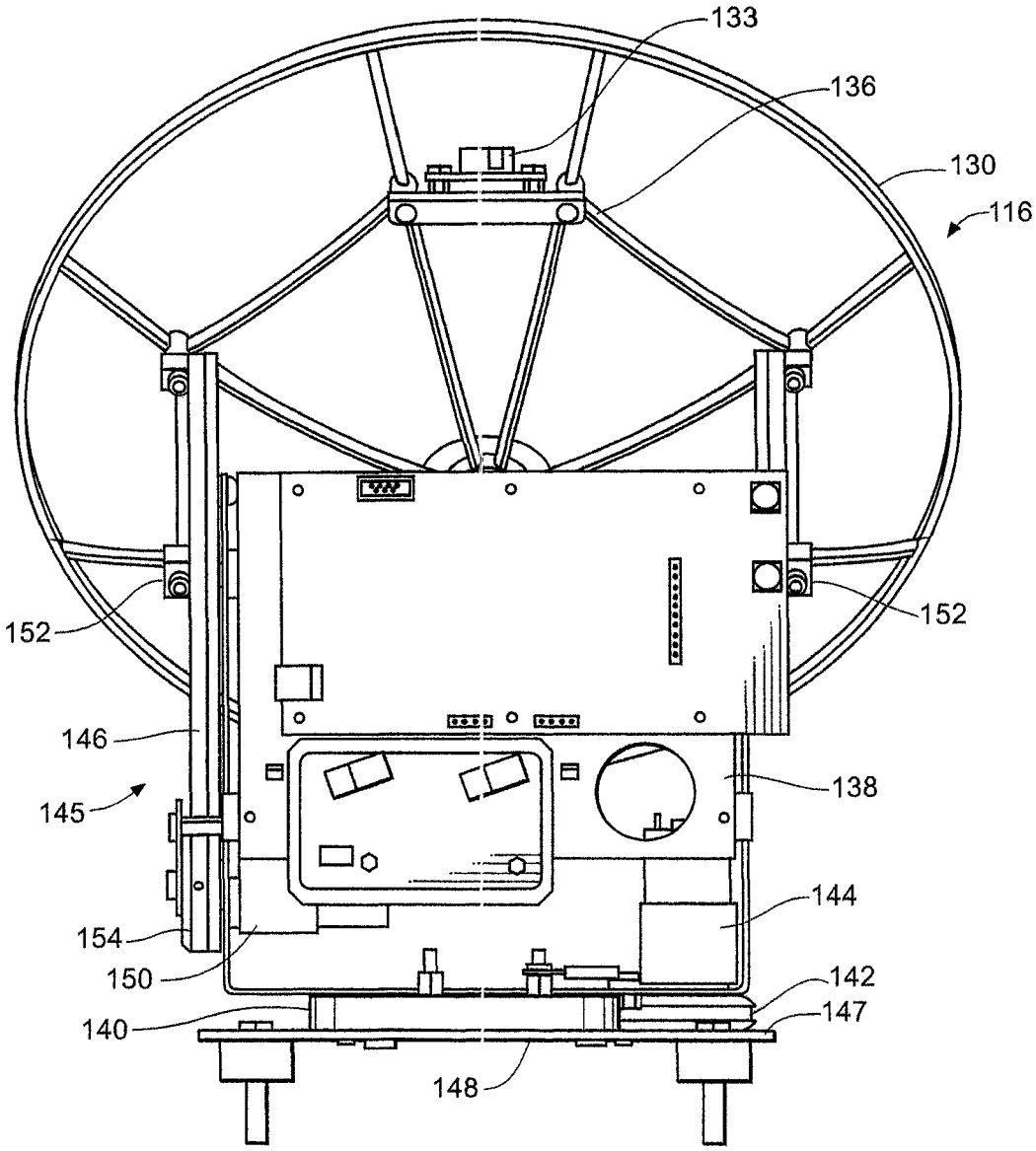
FIG. 9 is a satellite antenna system for an enclosed mobile satellite antenna system according to one example embodiment.
Figure 10:
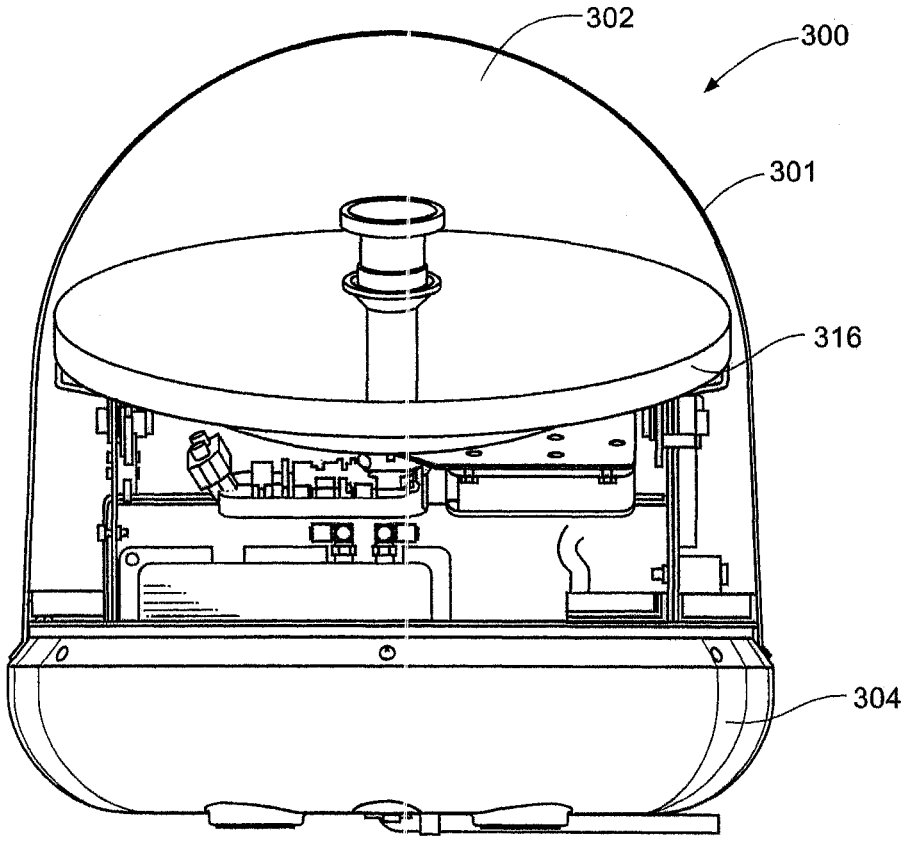
FIG. 10 is an enclosed mobile satellite antenna system according to one example embodiment.
Figure 11:
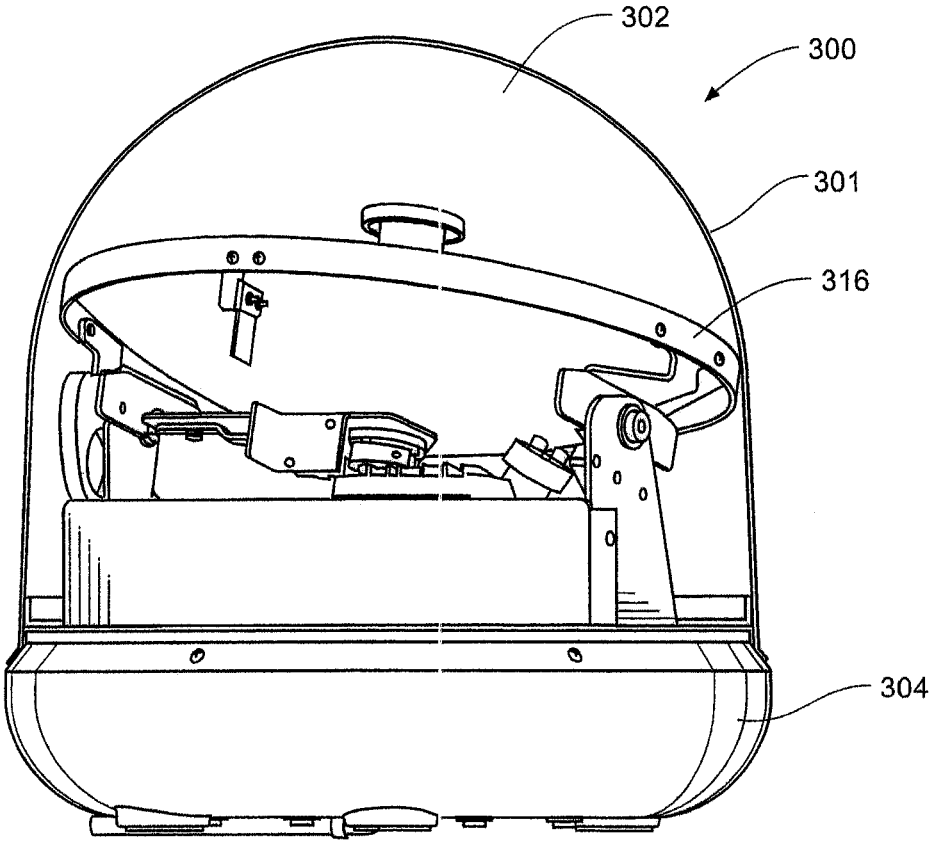
FIG. 11 is an enclosed mobile satellite antenna system according to one example embodiment.
Figure 12:
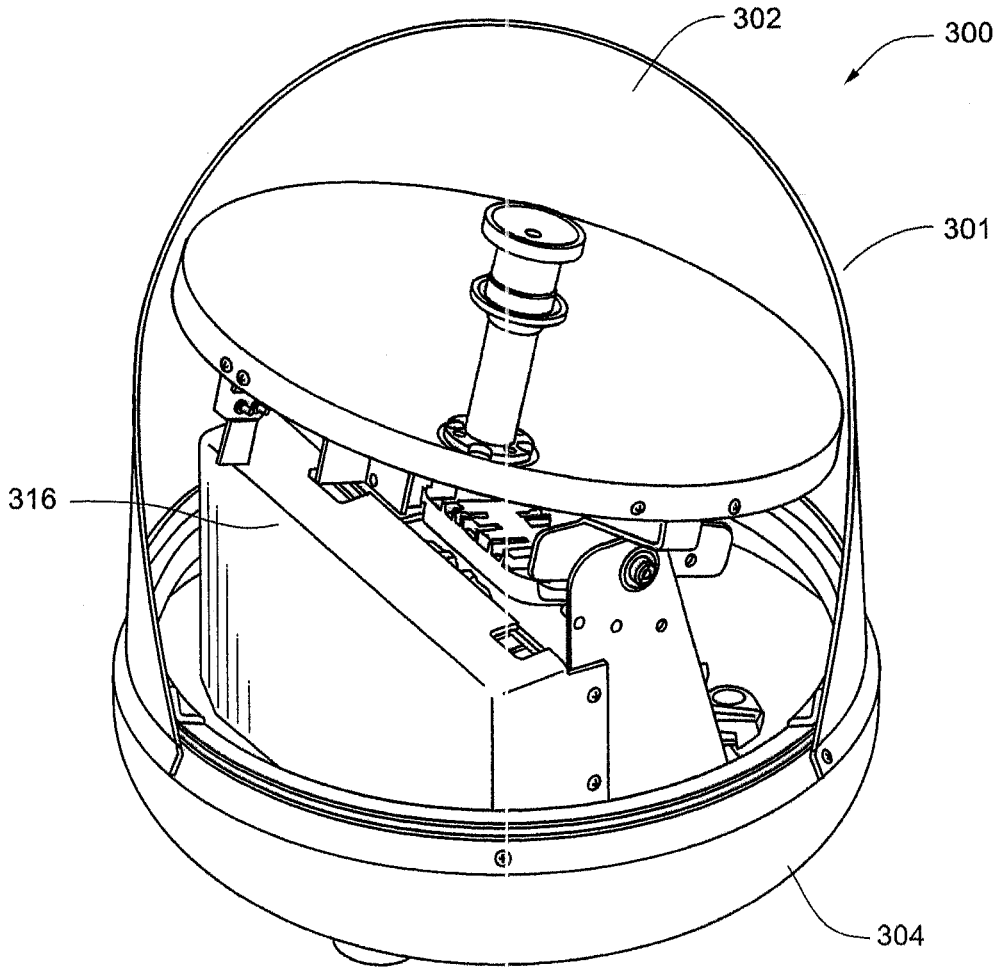
FIG. 12 is an enclosed mobile satellite antenna system according to one example embodiment.
Figure 13:
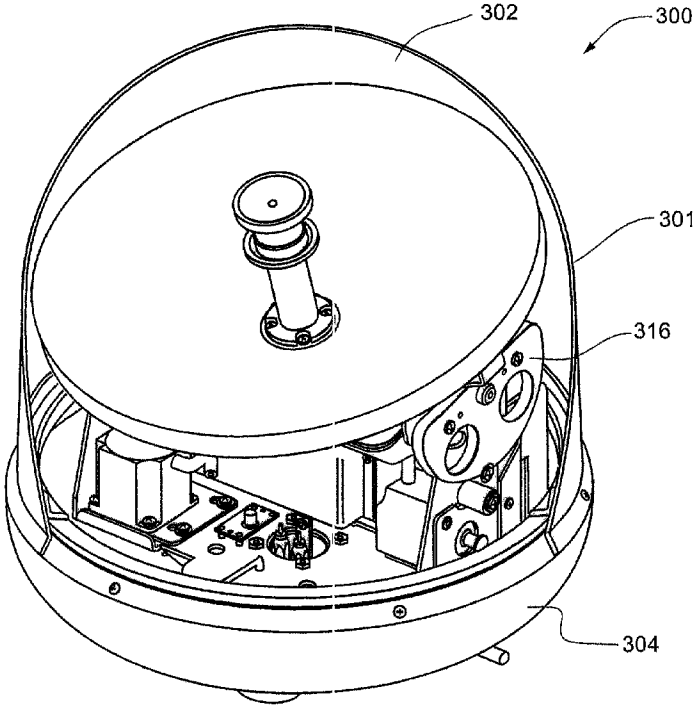
FIG. 13 is an enclosed mobile satellite antenna system according to one example embodiment.

One embodiment of a bracket 200 that can be used to mount mobile satellite antenna system to a vehicle or other structure is depicted in FIG. 5. Bracket 200 can include a mounting portion 202 and a platform portion 204. Mounting portion 202 can be permanently or non-permanently mounted to a vehicle or other structure. Platform portion 204 can be connected to mounting portion 202 with a plurality of nuts and bolts 206. Enclosed mobile satellite antenna system can be rested on or attached to platform portion 204. Platform portion 204 can include a pair of elongated slots 208 that allow the positioning of platform portion 204 relative to mounting portion 202 to be adjusted.

A non-permanently attached enclosed mobile satellite antenna system allows users to use such a system without any modifications to the structure of the vehicle or other structure on which it is mounted. This may be necessary for commercial long-haul drivers who do not drive their own trucks and may not have the authority to permanently modify the vehicle, such as by drilling holes through the vehicle, to accommodate a permanently attached system. A non-permanently attached system can also easily be moved from structure to structure.

A non-permanently attached enclosed mobile satellite antenna system can also be portable so that it can be used away from the vehicle. As shown in FIGS. 1-4, a dielectric handle 126 can be attached to the enclosure 101 of the system 100. System 100 can be constructed to have a light weight and a small profile to allow for easy manual carrying of the system 100 by handle 126. In one embodiment, handle 126 is configured to allow enclosure 101 to be carried with one hand. In one embodiment, system 100 weighs less than 20 pounds. In another embodiment, the system 100 weighs as little as 10.5 pounds. The handle 126 can be positioned such that when system 100 is carried by handle 126, bottom surface 110 is oriented at an angle to the ground. A manually portable system allows satellite reception at remote locations where vehicles do not have access, in non-permanent structures, and in permanent structures not equipped with a standard satellite antenna hardwired to the structure. In another embodiment, a dielectric carrying case can contain the system. It will be apparent to those of skill in the art that various other dielectric features could be used to provide portability to such a system.

An advantage of embodiments of the mobile satellite antenna system of the present invention is that no setup of the enclosure or satellite dish is required to use the system after it is transported. The satellite antenna dish and related structure contained within the enclosure are transported in the same configuration in which they are used. Thus, the center of mass of the system is the same when it is being carried as when it is being used. The system can therefore be carried from place to place and be immediately ready for use when it is set down, generally pointed in a southern orientation (for location in the northern hemisphere) by, for example, orienting the system relative to the position of the handle and then powered on. This allows a user to quickly and easily move the system to new locations without having to expend the significant time it can take to set up prior portable systems that require additional setup at each new location.

One embodiment of a satellite antenna system 116 that can be contained within enclosure is depicted in FIGS. 6-9. Satellite antenna system 116 includes a reflector dish 130 and a feedhorn or subreflector 132. In one embodiment, the reflector dish 130 can be parabolic. Feedhorn 132 collects incoming signals at the focus of dish 130. Incoming satellite signals are channeled from feedhorn 132 to a low noise block (LNB) converter 134. LNB converter 134 amplifies the signals and converts them from microwaves to low frequency signals transmitted through a coaxial cable to at least one receiver. Receiver converts signals so they can appear on the screen of a television. In one embodiment, a single feedhorn and LNB are provided within the enclosure. In other embodiments, multiple feedhorns and multiple LNBs or a multiplexed LNB may be provided within the enclosure. A digital video broadcast ("DVB") decoder can be provided, such as on control board 139, to decode satellite identification information being broadcast by the various target satellites.

Figure 14:
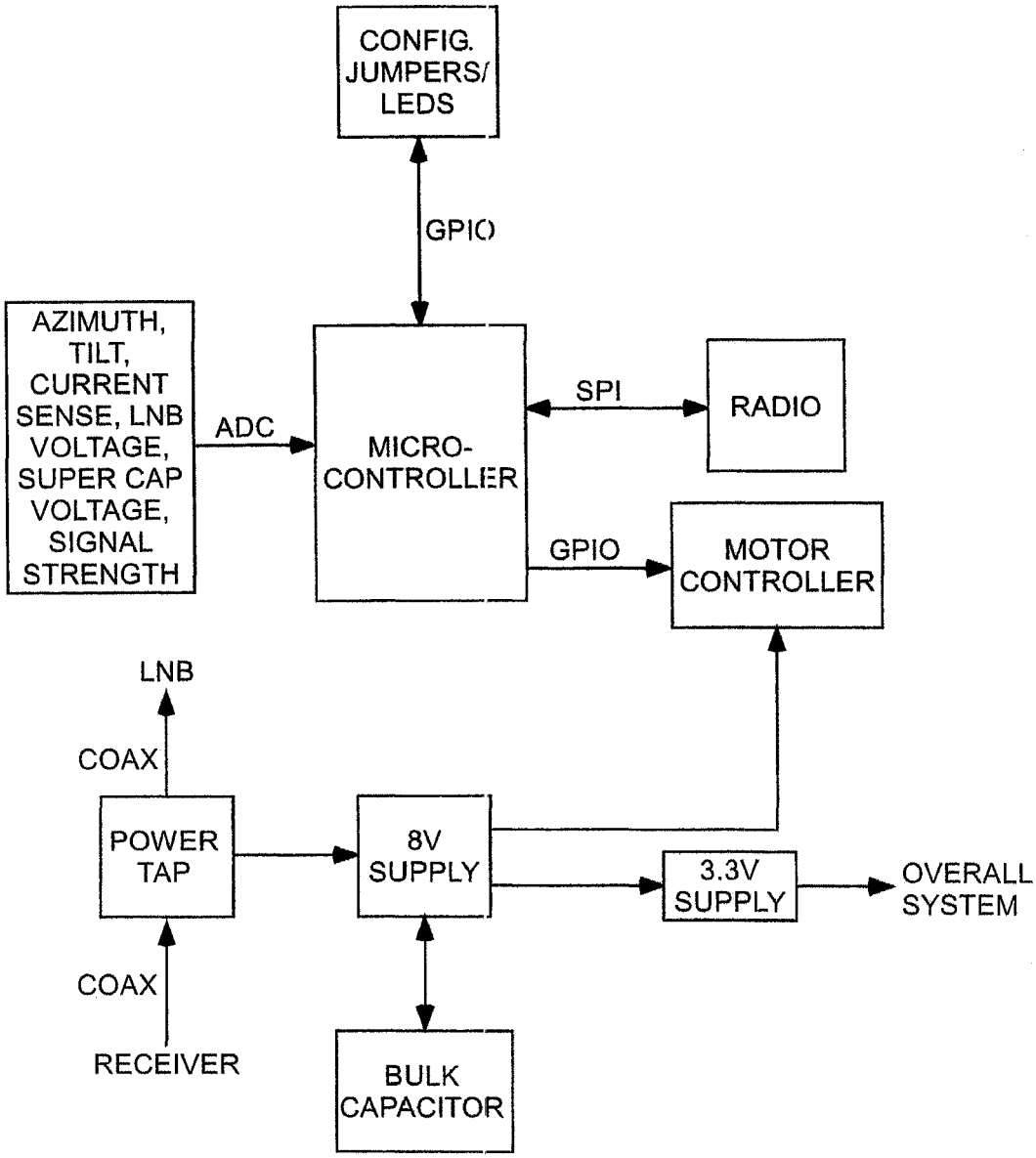
FIG. 14 is a block diagram of a control board for an enclosed mobile satellite antenna system according to one example embodiment.

In one embodiment, positioning of dish 130 is carried out by a motorized elevation drive system and a motorized azimuth drive system that are controlled by a control system. A block diagram of a control board for satellite antenna system 116 according to one embodiment is depicted in FIG. 14.

Dish 130 is connected to mounting unit 145. Mounting unit 145 includes a rotatable mount 138 and a tilt mount 146. Rotatable mount 138 is movably connected to bearing mount 140. Rotatable mount 138 rotates by wheel 142 as directed by motor 144. Thus, azimuth or pointing direction of dish 130 is affected by the frictional interaction of wheel 142 against the interior surface 147 of base 148. Base 148 is attached to enclosure 101 to secure mobile satellite antenna system 116 within enclosure 101. In one embodiment, rotation of dish 130 is limited to one complete revolution so as not to damage the cables connecting dish 126 to receiver. In other embodiments, dish 130 can make multiple rotations. When a potentiometer operably attached to the rotatable mount 138 detects that the dish 130 is at the end of its travel or a sensor arrangement detects positioning at a calibrated or predetermined position, an electronic command can be sent to shut off motor 144. Potentiometer or sensor arrangement can also transmit feedback to the user regarding the azimuth position of the dish 130.

Elevation of dish 130 is carried out by way of tilt mount 146. Tilt mount 146 is pivotable relative to rotatable mount 138 about pivot pins 152 and is rotated by wheel 154 attached to motor 150. In one embodiment, an electronic leveler sensor 133 can be disposed on a sensor bracket 136 attached to the rear face of dish 130. The electronic leveler sensor 133 can transmit feedback to the user regarding the elevation of the dish 130. When the electronic leveler sensor 133 senses that the dish is at the end of its travel or a sensor arrangement detects positioning at a calibrated or predetermined position, an electronic command can be sent to turn off motor 150. In various embodiments, the electronic level sensor 133 may be an accelerometer, gyroscope or fluid based sensor arrangement.

Figure 15:
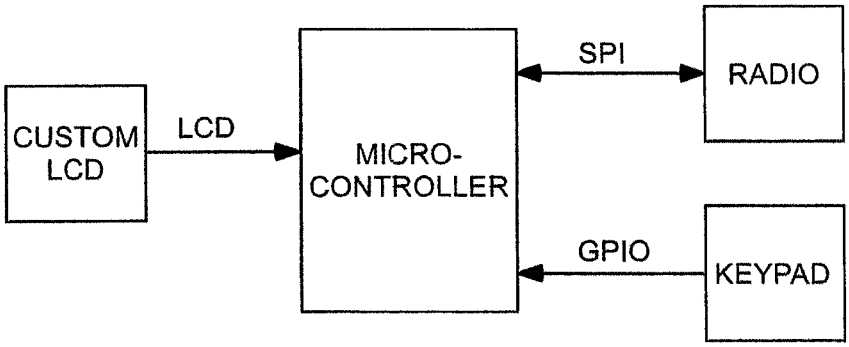
FIG. 15 is a block diagram of a control board for a remote control of an enclosed mobile satellite antenna system according to one example embodiment.
Figure 16:
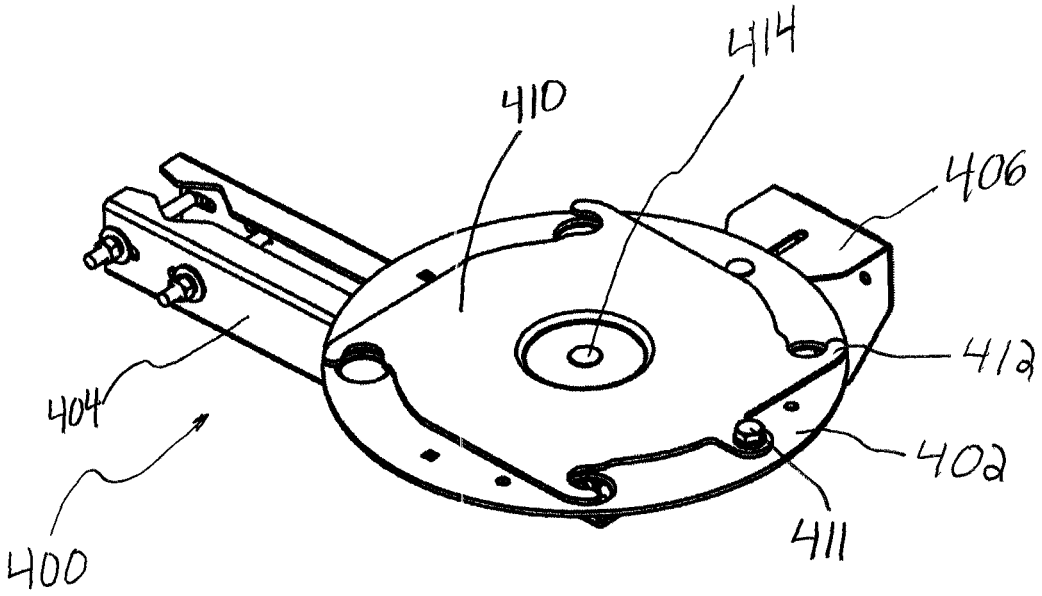
FIG. 16 is a perspective view of a mounting bracket according to one example embodiment.
Figure 17:
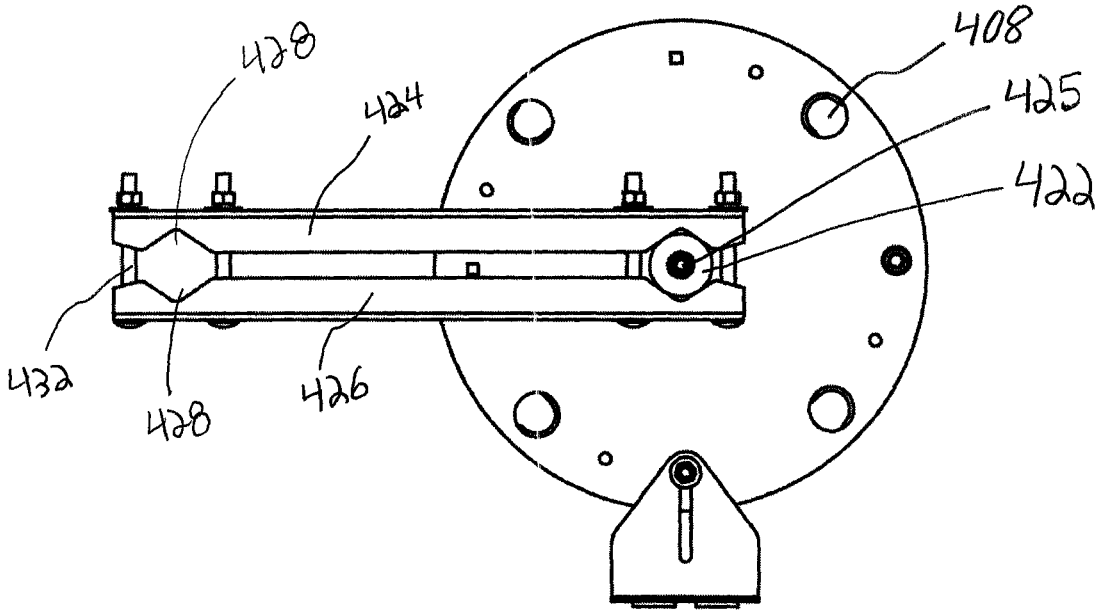
FIG. 17 is a bottom view of a mounting bracket according to one example embodiment.
Figure 18:
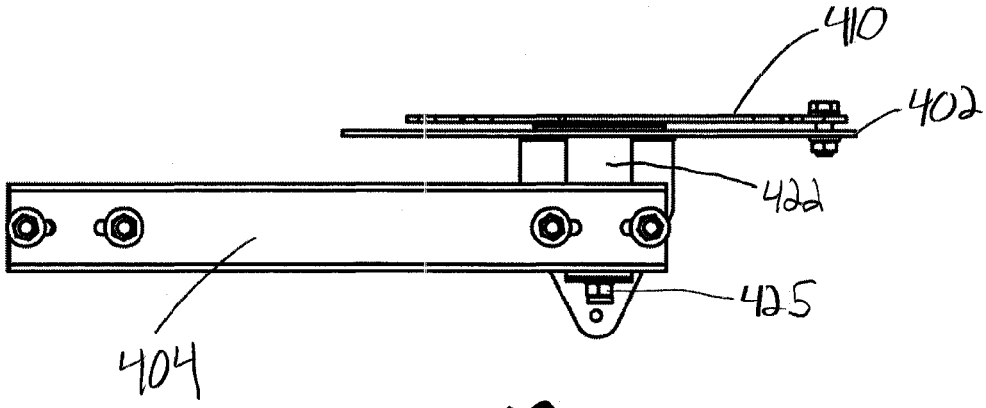
FIG. 18 is a first side view of a mounting bracket according to one example embodiment.
Figure 19:
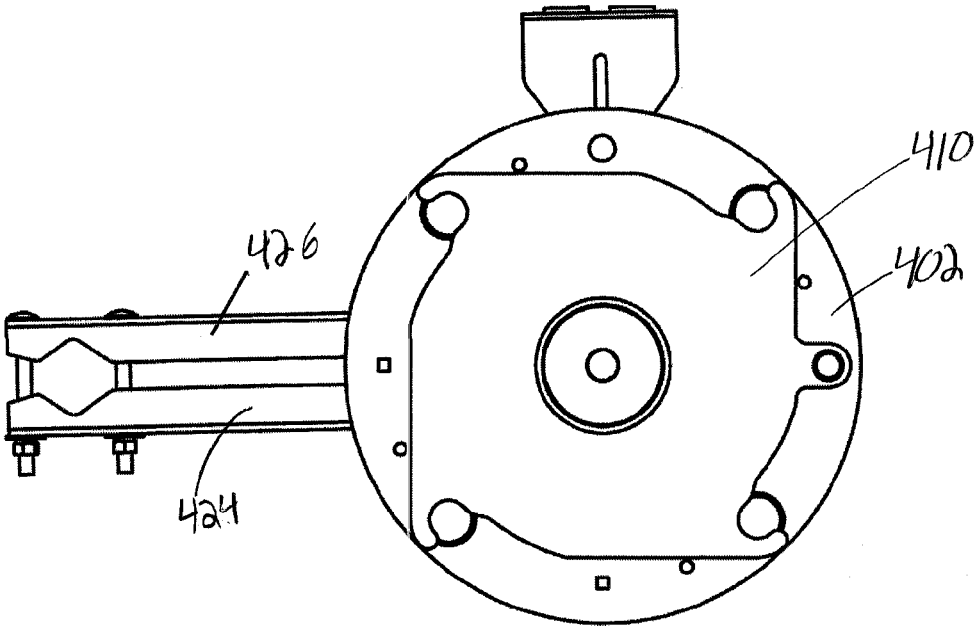
FIG. 19 is a top view of a mounting bracket according to one example embodiment.
Figure 20:
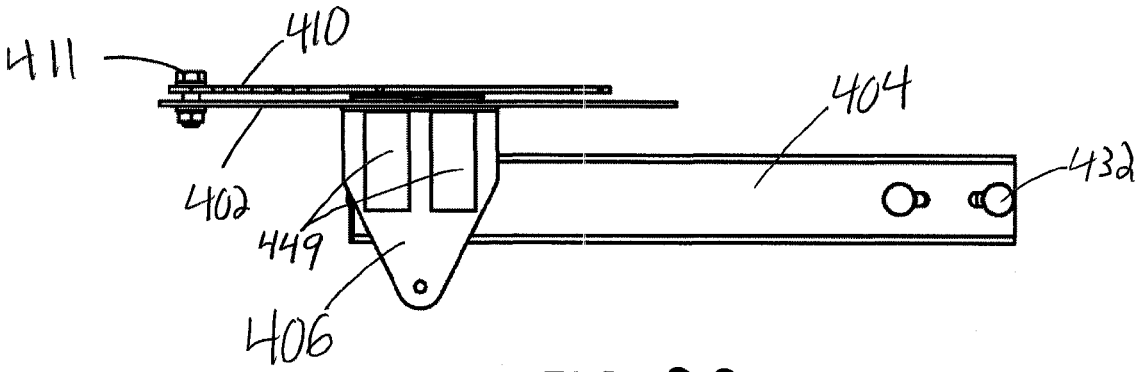
FIG. 20 is a second side view of a mounting bracket according to one example embodiment.
Figure 21:
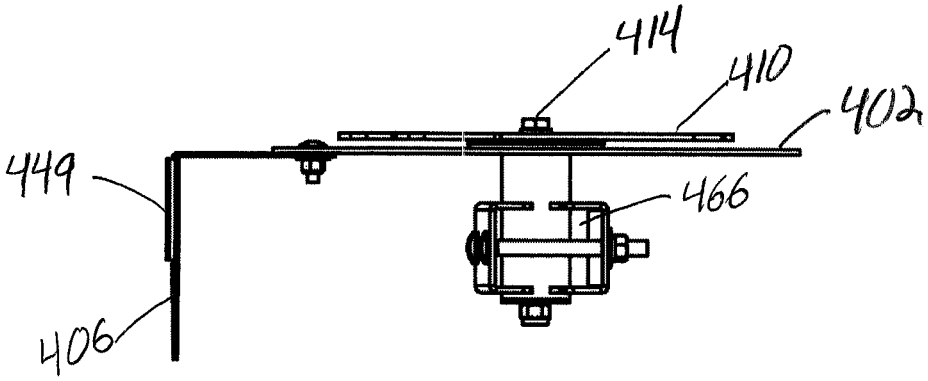
FIG. 21 is a first end view of a mounting bracket according to one example embodiment.
Figure 22:
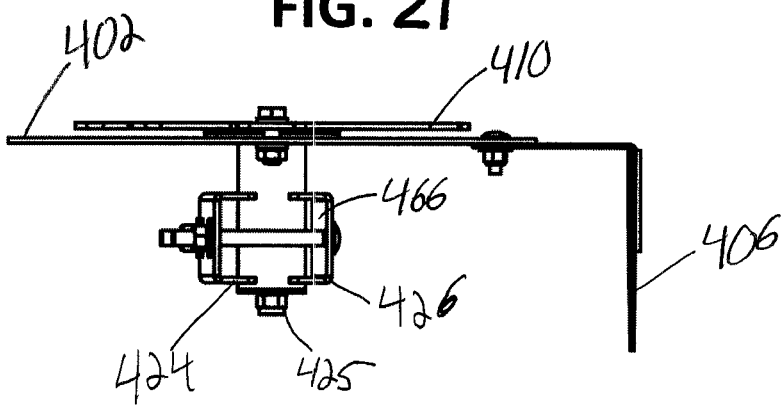
FIG. 22 is a second end view of a mounting bracket according to one example embodiment.

In one embodiment, the parabolic dish 130 of an enclosed mobile satellite antenna system can be positioned via wireless transmission of signals between the system and a remote used to position the antenna. Alternatively, the remote may be hard wired or may utilize the coaxial cable. When the enclosed mobile satellite antenna system changes location (or when a vehicle to which it is attached changes location), the system's dish needs to be repositioned to acquire a satellite signal. To reposition the dish, a remote device with an RF transceiver can be used to communicate with a transceiver inside the enclosed mobile satellite antenna system. The remote can be used to reposition the dish from either the inside or the outside of a vehicle or other structure outside of which enclosed mobile satellite antenna system is located. The remote can be programmed to transmit signals to move the dish up and down in elevation and left and right in azimuth. The remote receives feedback from the transceiver in the enclosed mobile satellite antenna system regarding dish position and can display the information alphanumerically or graphically to the user. In one embodiment, the position of the dish in elevation is given in degrees from the horizon and the azimuth position is given graphically and corresponds to the position of the dish relative to the vehicle or other structure. In other embodiments, azimuth can be given relative to the enclosure, the handle, or the coaxial connector. Graphical feedback can also be given to the user when the dish reaches the end of its travel in any direction (up, down, left, or right.). A block diagram of a control board of a remote according to one embodiment is depicted in FIG. 15.

In one embodiment, the procedure to wirelessly acquire a satellite signal when repositioning the dish is to 1) turn on the receiver and navigate to the signal meter screen; 2) enter the zip code or other information into the receiver by following the on-screen instructions to indicate location; 3) use the up and down buttons on the remote to move the dish to the correct elevation as displayed on the signal meter screen; 4) use the left and right buttons on the remote to rotate the dish until the satellite signal is observed on the signal meter screen; and 5) use all four positioning arrows to fine tune the position of the dish to maximize the satellite signal acquisition. In another embodiment, the dish can be positioned via a wired connection to a remote or other user interface. The dish can be positioned as described above with or without direct user positioning. In order to eliminate direct user positioning, the wireless positioning signal can be transmitted and received to automatically position the dish.

Positioning of the dish and acquisition of satellite signals can be accomplished by various means of automatic and semi-automatic positioning. The system can also include means for automatically leveling the satellite dish as it rotates. The system can also include various techniques for storing satellite positions and jumping between or among satellite positions and/or satellite providers, either by operation of a remote or in response to a user changing channels and/or providers at a satellite receiver. Such procedures are disclosed in U.S. Pat. Nos. 6,538,612; 6,710,749; 6,864,846; 6,937,199; and 7,301,505, which are hereby incorporated by reference in their entirety, except for the claims and any express definitions that are inconsistent with the present application.

In addition to stationary semi-automatic operation and stationary automatic operation, the present motorized antenna system can also be configured for in-motion operation. In-motion systems have the capability to track one or more broadcast targets, such as a satellite location, while the vehicle that the antenna system is attached to is moving. For example, the system may be mounted to a recreational vehicle that is driving on the road. Another example application is the system sitting on the deck of a boat or releasably mounted to the boat using a mounting bracket as described earlier. Motion sensors, for example one or more angular rate sensors, are operably coupled to the system in order to provide information to the electronic controls to permit adjustment of the antenna angle, rotation or both while the vehicle is in motion. The sensor and corresponding programming of the control electronics allows the antenna to remain pointing at the broadcast target regardless of which way the vehicle that the system is disposed on is moving.

The motorized antenna system may also be configured to utilize a rotary joint to connect one or more cables from the antenna to the electronics in the vehicle. The antenna in certain embodiments may be configured to rotate within the enclosure. In such instances, there must be sufficient extra cable length to permit winding of the cable to adequately rotate, for example through 360 degrees of rotation. Rotation is bounded by the maximum extra cable length. Use of a rotary coupling permits infinite rotation without cable binding. This is particularly useful for in-motion system configurations because it eliminates the need for periodic unwinding operations.

Rotary joints also permit semi-automatic and automatic stationary systems to begin searching for broadcast signals upon startup. Otherwise, these systems must first locate the antenna position within the enclosure to ensure that binding does not occur. The limit switches or other means or methods for performing a locating procedure may therefore be eliminated with the use of a rotary joint. Simplification of components reduces system costs. Exemplary rotary joints are disclosed in U.S. Pat. Nos. 6,188,367 and 7,372,428, both of which are hereby incorporated by reference in their entirety, except for the claims and any express definitions that are inconsistent with the present application.

In one embodiment, signals can be transmitted wirelessly from the satellite antenna system to the receiver. Once the satellite antenna system acquires a satellite signal, such as a 1.2 GHz Ku-band signal, it must then be transmitted to the receiver, often located in the interior of a vehicle or other structure. The signal is first modified through a series of electronics in the satellite antenna system to another frequency, such as 2.4 or 5.2 GHz. The signal is then transmitted from the outside of the structure to the inside of the structure wirelessly. Inside the structure, the wirelessly transmitted signal is received and, through a series of electronics, modified back to its original 1.2 GHz frequency and transmitted via wire to the receiver. In other embodiments, satellite antenna system can acquire various other satellite signals, such as, for example, Ka-band signals.

Wireless communication of dish positioning and signal transmission allows for easy installation of enclosed mobile satellite antenna systems because few or no wires or harnesses need to be passed from the outside of a structure, such as a vehicle, into the interior of the structure. In addition, fewer wires are needed on the inside of the structure. Wireless communication as described above can also be used with non-mobile satellite antenna applications.

In another embodiment, power can be supplied to an enclosed mobile satellite antenna system to power the motors, satellite signal acquisition and amplification devices, and ancillary electronics by sources that do not require additional harnesses or wiring. In one embodiment, power is transmitted to the enclosed satellite antenna system from the receiver through the coaxial cable that is also used to transmit satellite signals from the antenna system to the receiver (if not done wirelessly). Alternatively, solar power generated by a photovoltaic cell or wind power such as captured using a small turbine can be used to power the enclosed mobile satellite antenna system. Power from either of these sources (located outside of the vehicle) can be transmitted by a coaxial cable and stored inside the enclosed mobile satellite antenna system with a battery. In one embodiment, the battery can be a standalone battery located in the enclosed mobile satellite antenna system enclosure. Alternatively, the battery can be included on the system's electronic control unit in the form of a supercapacitor or battery on the PCB.

When dish positioning is performed wirelessly, powering the enclosed mobile satellite antenna system with the receiver allows for installation and operation with only a single coaxial cable between the exterior of a structure and the interior of the structure. This also makes the antenna fully functional whenever the receiver is turned on, so there need be no human interaction with the antenna system because all control of the dish can be done automatically. This makes the viewing experience more similar to the non-mobile environment where the user does not need to reposition the dish each time the user desires programming. When the antenna system is powered through solar or wind power and the dish positioning is controlled wirelessly, no wires need to be passed between the interior and the exterior of a structure.

Another embodiment of an enclosed mobile satellite antenna system 300 is depicted in FIGS. 10-13. Enclosed mobile satellite antenna system 300 includes an enclosure 301 with a satellite antenna system 316 therein for acquiring and transmitting a satellite signal. Enclosure 301 can include a cover 302 and a base 304. Note that enclosed mobile satellite antenna system 300 is shown with a portion of cover 302 missing so that the interior satellite antenna system 316 can be displayed. Satellite antenna system 316 includes similar componentry and functions similarly to satellite antenna system 116 described previously. Enclosure 301 can optionally be provided with a handle to provide for easily transportability and manual carrying of enclosed mobile satellite antenna system 300.

Another embodiment of a mounting means is shown in FIGS. 16-28. The bracket 400 includes a mounting plate 402 and a support arm 404. The mounting plate 402 is configured to securely retain the antenna enclosure. The mounting plate 402 is disposed on one end of the support arm 404. The opposing end of the arm 404 is securable to a vehicle. In addition, a stabilizing bracket 406 may be secured to the mounting plate 402 to provide added stability when mounted on a vehicle.

The mounting plate 402 in one embodiment is a generally flat circular disk that has a slightly larger surface area than the bottom of the antenna enclosure. A plurality of apertures or holes 408 are defined in the plate 402. The holes 408 are sized and arranged to correspond to the size and arrangement of the feet on the bottom of the enclosure. The hole size may be chosen to tightly hold the feet in place. This may be accomplished by way of an interference fit. However, other mechanisms may be used for retention such as slots in the plate that are of a smaller width or diameter than the holes, into which the feet (or notches in the feet) may be rotated, thereby securing the enclosure. Other sizes and shapes of the mounting plate 402 may be utilized without departing from the scope of the invention.

In addition, a locking plate 410 may be disposed on the mounting plate 402 in order to mechanically engage and restrain movement of the enclosure's feet when located in the holes 408. The locking plate 410 has a plurality of fingers 412 that extend outwardly to engage a slot, groove, aperture or notch in the feet of the enclosure when the feet are placed in the holes 408. The locking plate 410 is rotatably fastened to the top side of the mounting plate 402 by a centrally located pin 414. The locking plate 410 can be rotated between open and engaged (or closed) positions. The locking plate 410 can be secured in the engaged position by placing a fastener, such as a bolt, through a hole or aperture 416 in a tab or extension 418 of the locking plate 410 and extending the fastener 411 though a corresponding hole or aperture 420 in the mounting plate 402.

Figure 23:
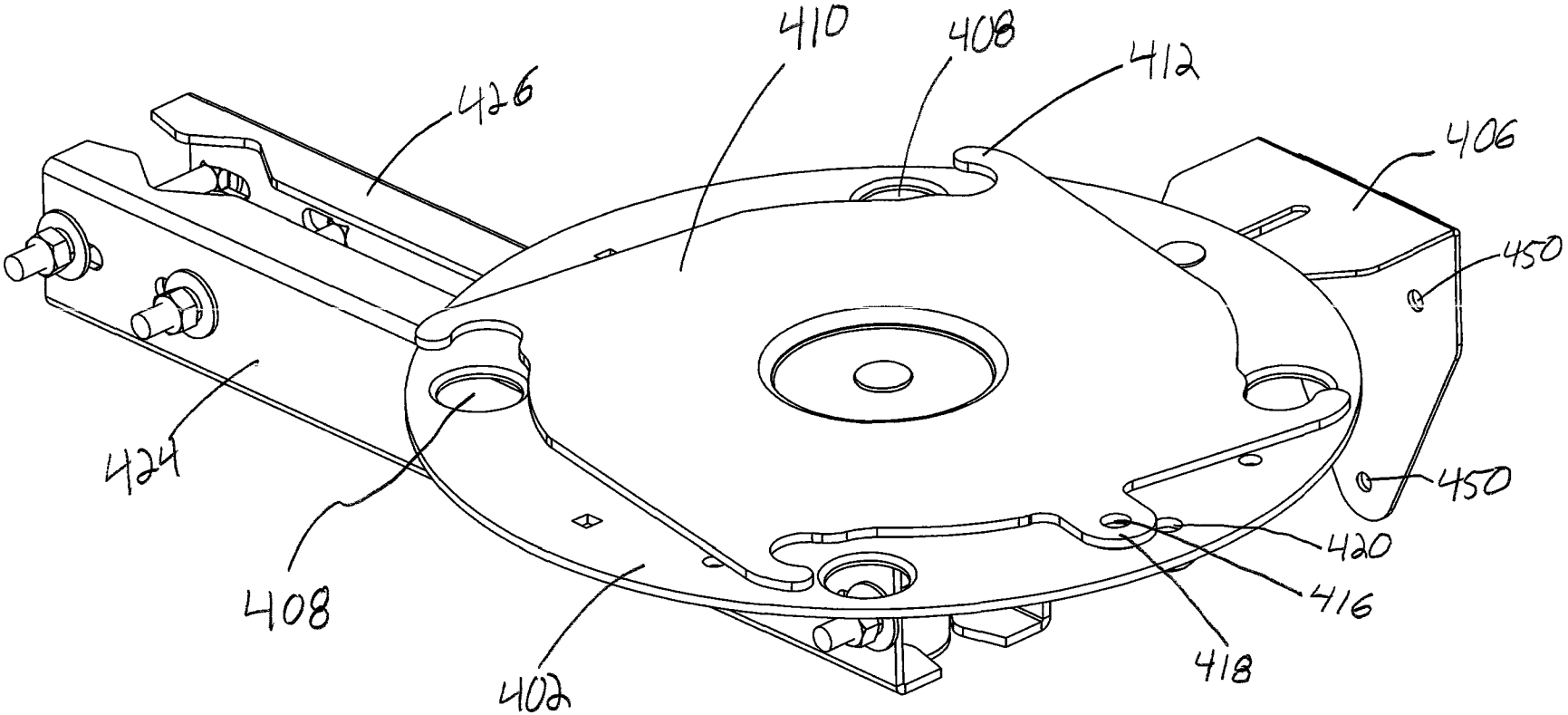
FIG. 23 is a perspective view of a mounting bracket in an opened condition according to one example embodiment.
Figure 24:
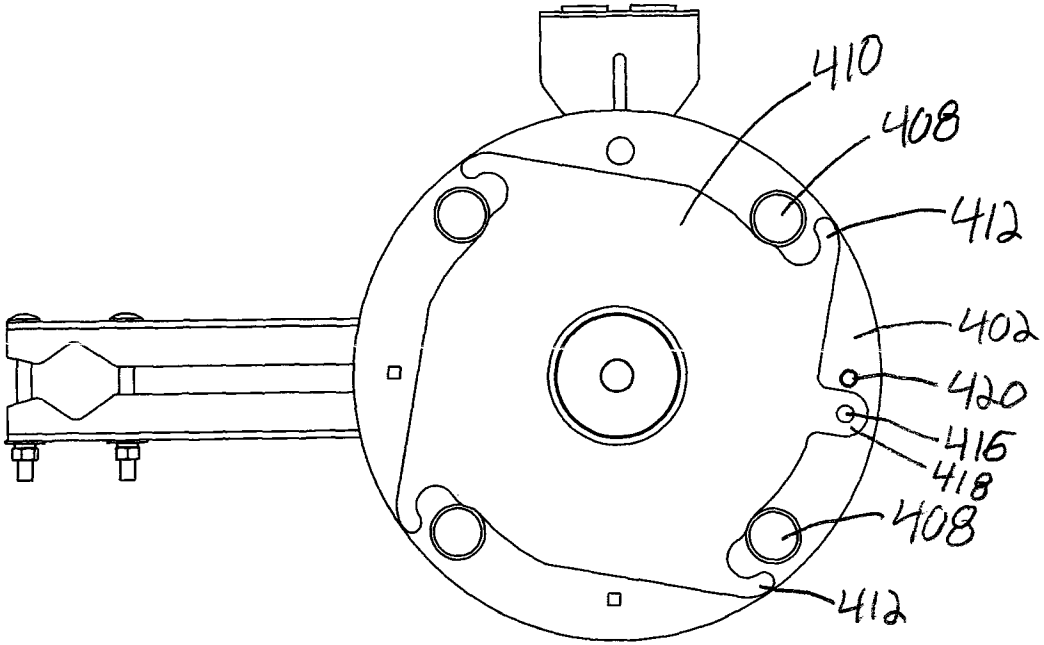
FIG. 24 is a top view of a mounting bracket in an opened condition according to one example embodiment.
Figure 25:
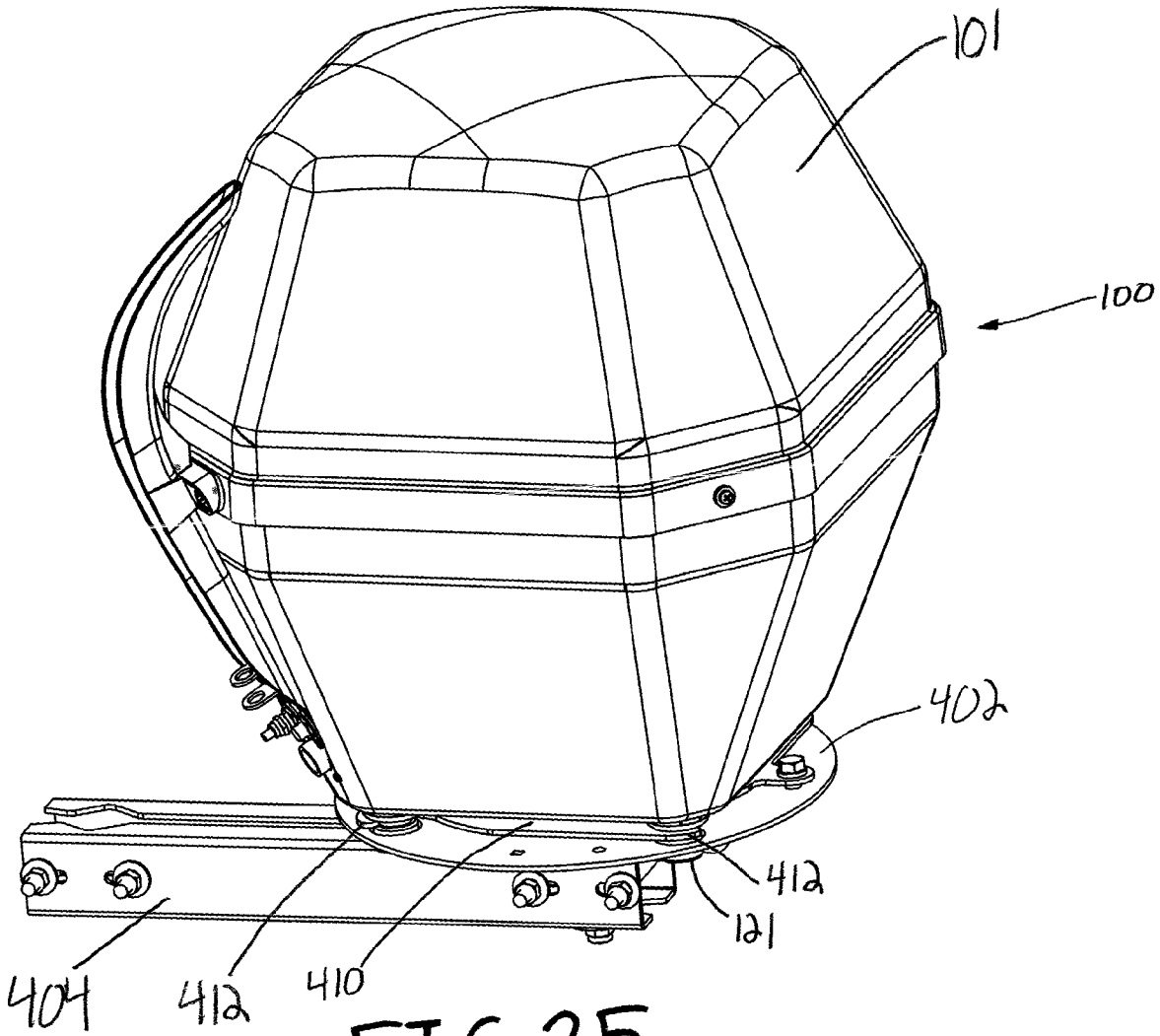
FIG. 25 is a perspective view of an enclosed mobile satellite antenna system secured to a mounting bracket according to one example embodiment.
Figure 26:
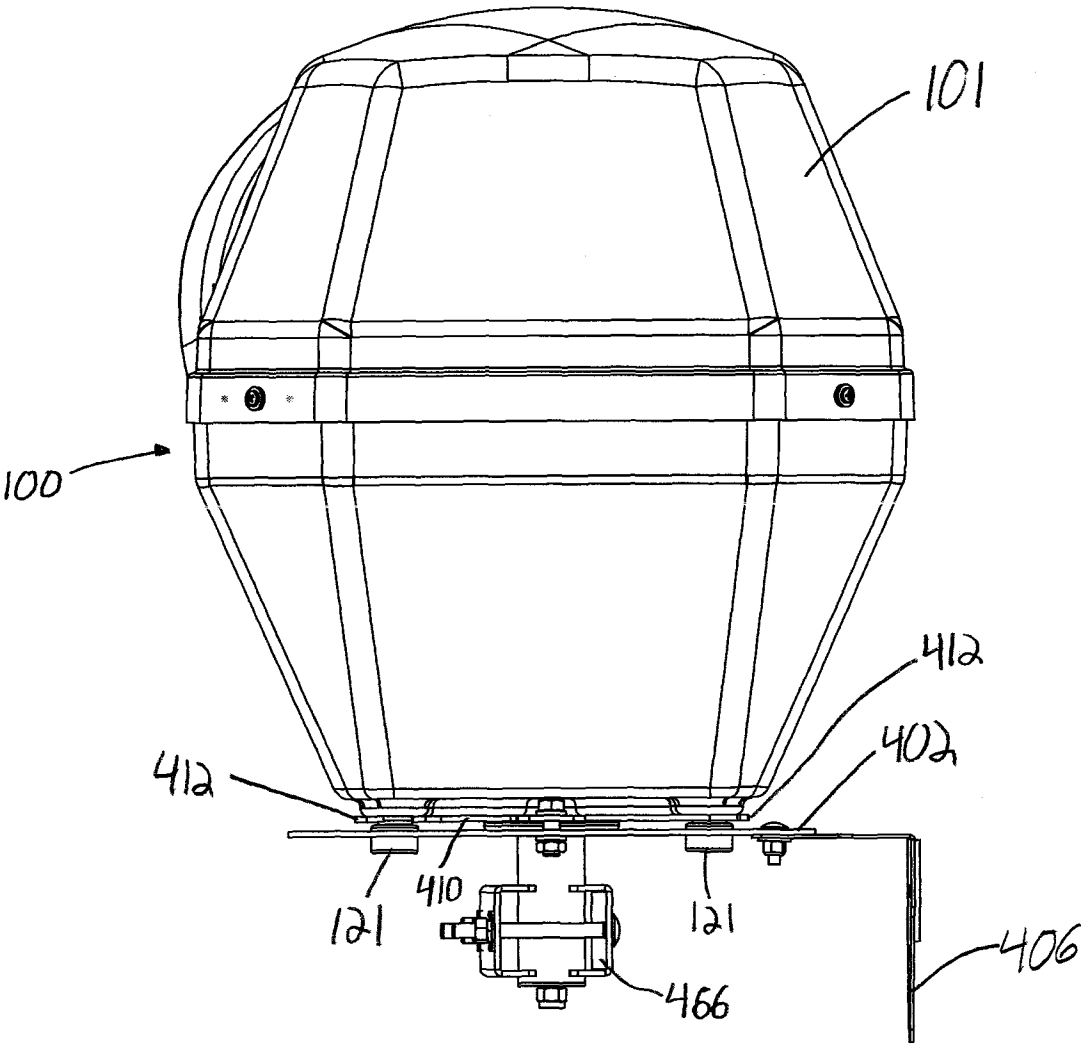
FIG. 26 is an end view of an enclosed mobile satellite antenna system secured to a mounting bracket according to one example embodiment.

Referring to FIGS. 23-24, the mounting plate 402 is shown with the locking plate 410 in an open position. The feet of an enclosure can then be placed into the respective receiving holes 408 of the mounting plate 402. Then, the locking plate 410 is rotated counterclockwise until the arms 412 engage the notches in the feet of the enclosure as shown in FIGS. 25-26. In this arrangement, the mounting plate 402 is the primary restraint for horizontal and rotational movement and the locking plate 410 is the primary restraint for vertical movement. However, as mentioned above, the mounting plate 402 may be configured to perform all restraint functions. It is understood that the invention includes configuring the locking plate for rotating clockwise to engage the enclosure.

The mounting plate 402 is disposed on a cylindrical hub 422. A pin 414 extends through the locking plate 410, mounting plate 402 and hub 422 to hold these items together. A locking nut 425 disposed on or in the end of the hub 422 can be used to fasten the pin 414. Other means for holding the locking plate 410, mounting plate 402 and hub 422 together, including a padlock, may be used without departing from the scope of the invention.

The support arm 404 comprises a first segment 424 and a second segment 426. Each segment has a generally C-shaped or sideways U-shaped cross section and has a length greater than its height. The length in one embodiment is sufficient to retain the antenna enclosure horizontally away from vehicle structures so that the enclosure does not touch any vehicle structure when fastened to the vehicle. A notch or inset 428 is defined in each segment proximate each end. A plurality of apertures, slots or holes 430 are formed in the outer wall of each segment to allow for the placement of fasteners 432. Alternatively, a single segment may be used without departing from the scope of the invention, for example, the segment may be generally U-shaped, square or cylindrical in cross section.

Figure 27:
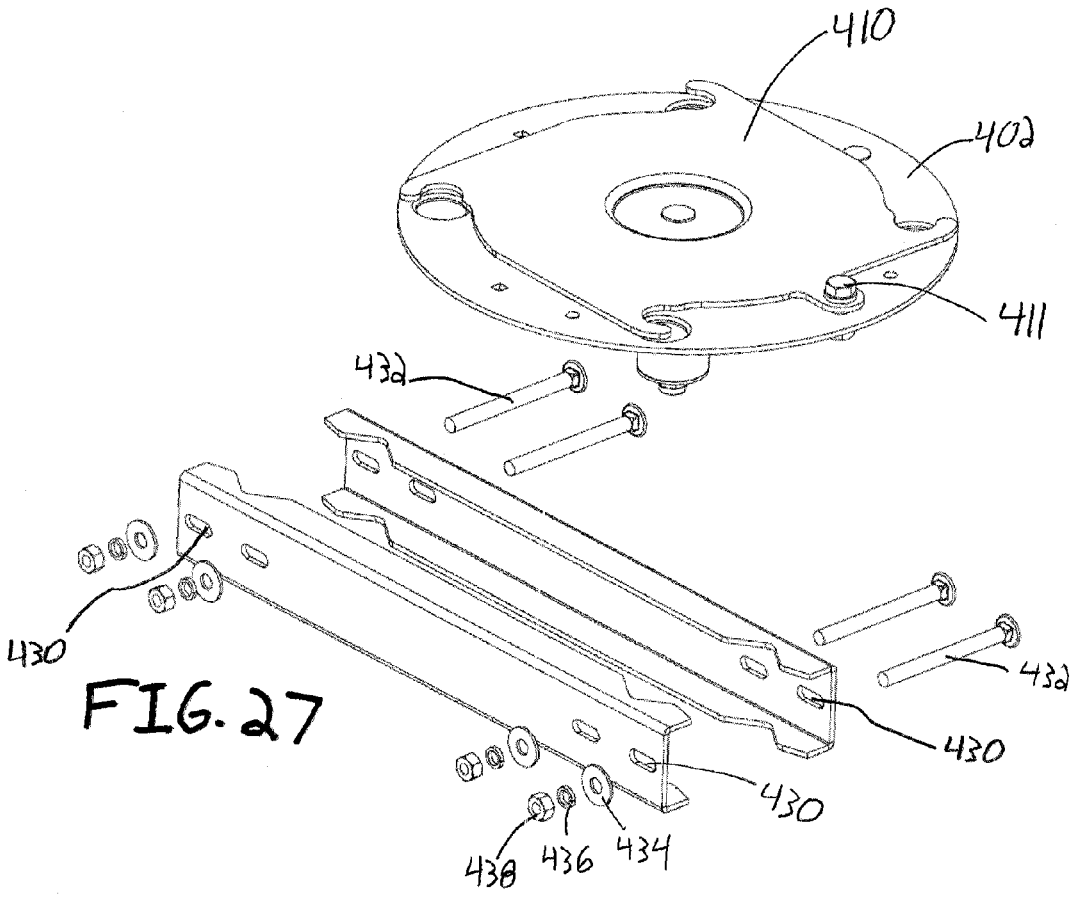
FIG. 27 is an exploded perspective view of a mounting bracket according to one example embodiment.

Certain bracket components are assembled as shown in the example depicted in FIG. 27. The mounting plate 402, locking plate 410 and hub 422 are assembled as described above. The support arm 404 segments 424, 426 are brought together so that the notches 428 are facing towards each other and aligned opposite each other. The hub 422 is placed in the gap formed between respective notches 428 at a first end of the support arm 404. The gap formed between the notches 428 at the opposing end of the support arm 404 can be used to grasp a vertical member disposed on the vehicle, for example, the side post of a ladder. A plurality of fasteners 432, such as carriage bolts, are inserted through the aligned slots 430 in the segments 424 and 426. Corresponding fastener components, such as washers 434, lock washers 436 and nuts 438 are placed on the carriage bolts. The fasteners 432 are then tightened. Other fastening means, for example quick release fasteners, may also be used within the scope of the invention. The mounting plate 402 may alternatively be fastened directly to the support arm 404.

Figure 28:
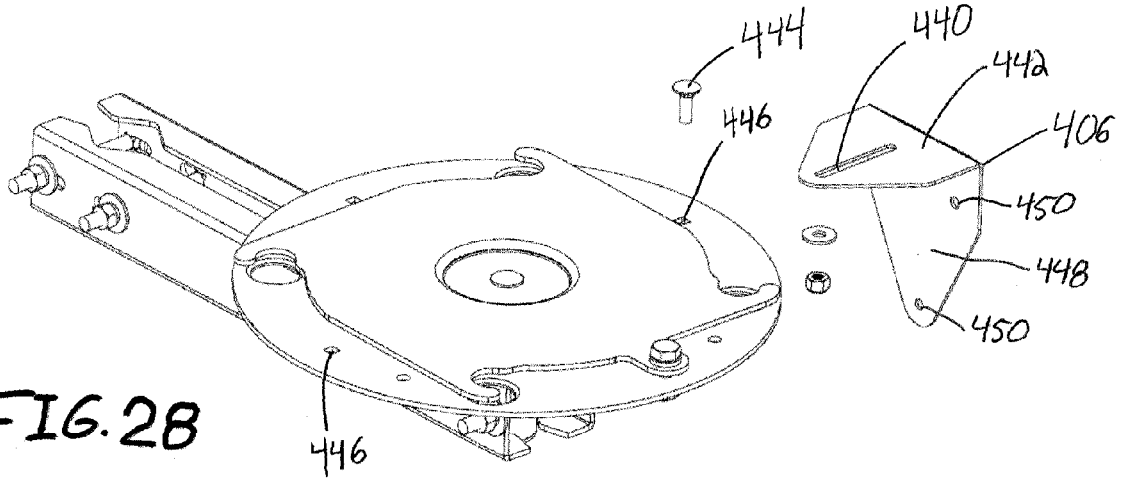
FIG. 28 is a perspective view of a mounting bracket with a stabilizing bracket, according to one example embodiment.

Referring to FIG. 28, a stabilizing bracket 406 may be fastened to the mounting plate 402 to add additional stability. A slot 440 is defined in the horizontally oriented portion 442 of the stabilizing bracket. A fastener 444 is used to fasten the stabilizing bracket 406 to the mounting plate 402 by insertion through the slot 440 and a corresponding aperture 446 in the mounting plate 402. The stabilizing bracket 406 is oriented such that the vertical portion 448 of the stabilizing bracket 406 faces away from the mounting plate 402. The outer surface of the vertical portion 448 of the stabilizing bracket 406 may be fastened to the side surface of a vehicle using double-sided foam tape 449. Alternative fastening means, including bolts, Velcro® brand hook and loop fasteners, and glue may be used, without departing from the scope of the invention. Apertures 450 are provided in the vertical portion 448 to facilitate alternative means of fastening to the vehicle. The stabilizing bracket 406 is located and configured so that it extends outwardly from the mounting plate 402 in a direction generally perpendicular to the length of the support arm 404. However, oblique extension angles are within the scope of the invention.

Figure 29:
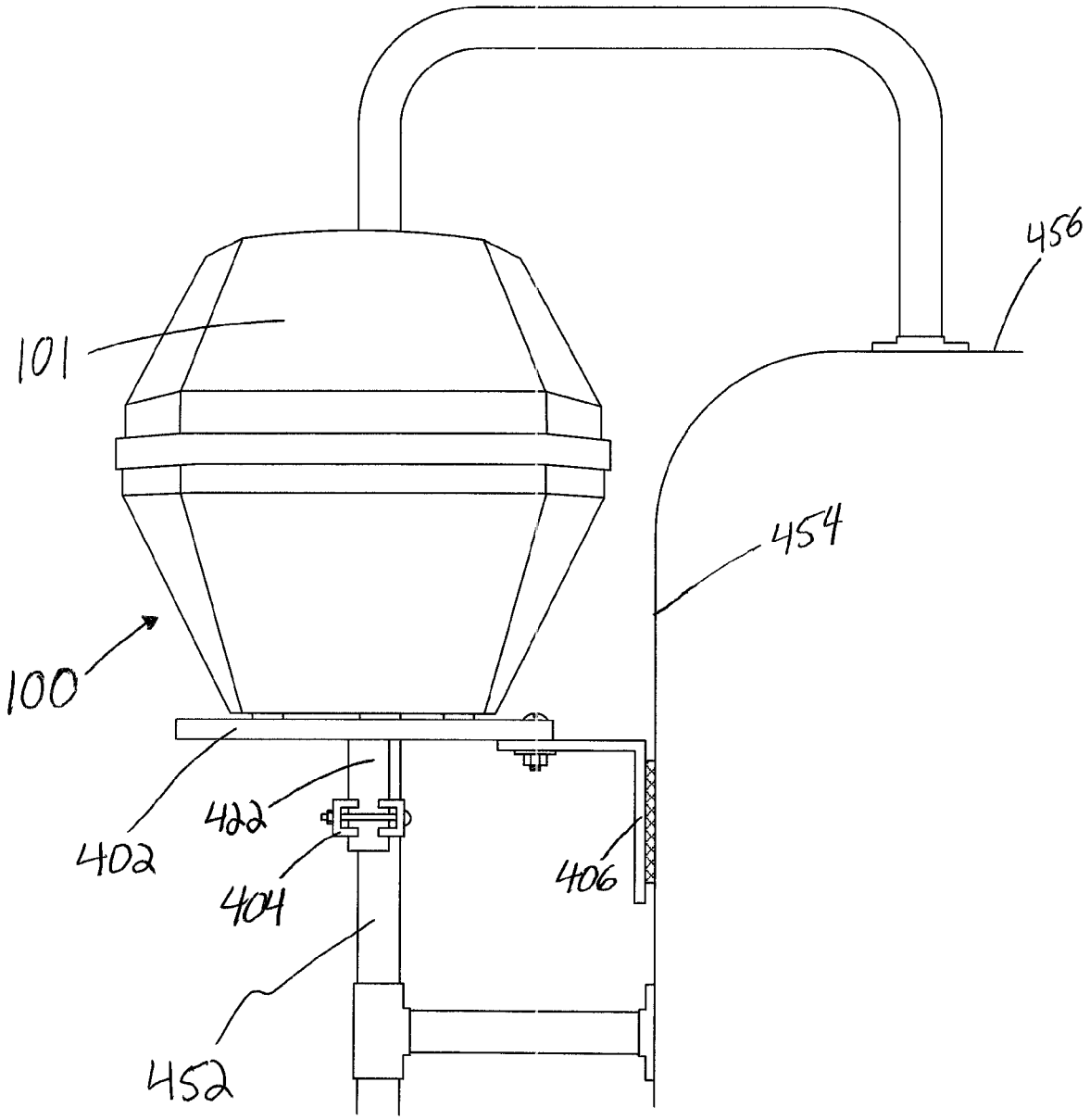
FIG. 29 is a side view of an enclosed mobile satellite antenna system disposed on a mounting bracket that is fastened to a vehicle, according to one example embodiment.
Figure 30:
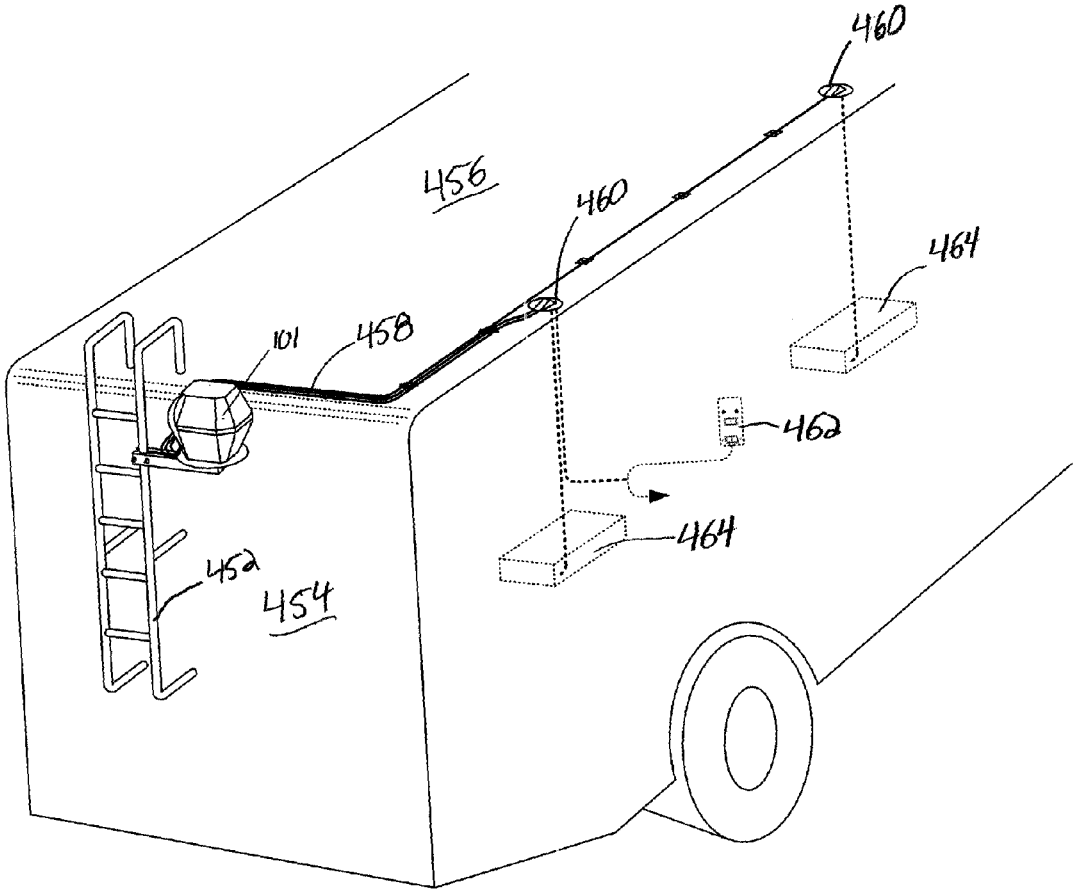
FIG. 30 is a perspective view of an enclosed mobile satellite antenna system disposed on a mounting bracket that is fastened to a vehicle, according to one example embodiment.
Figure 31:
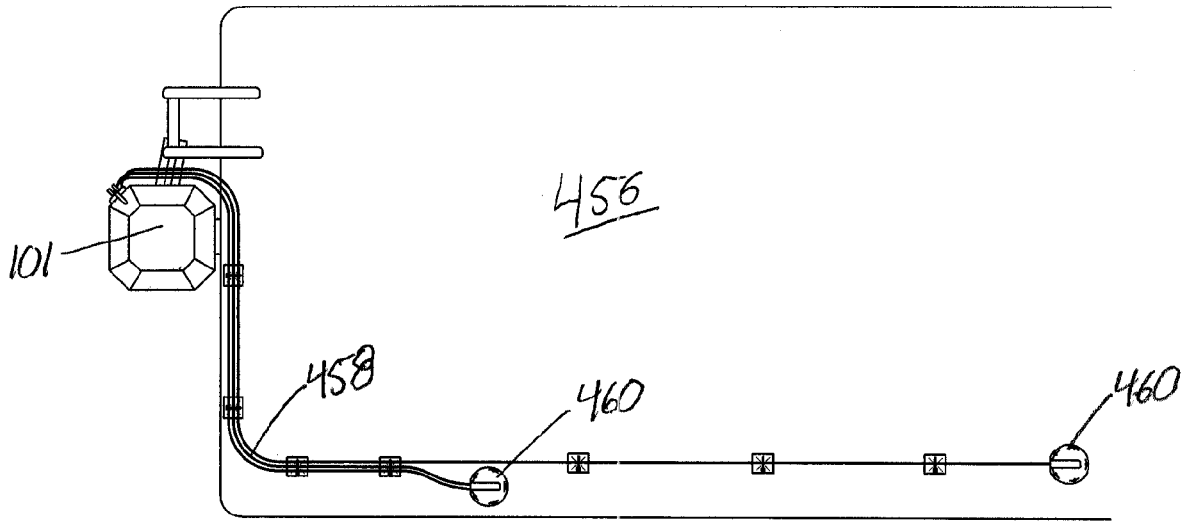
FIG. 31 is a top view of an enclosed mobile satellite antenna system disposed on a mounting bracket that is fastened to a vehicle, according to one example embodiment.

Referring to FIGS. 29-31, the enclosure 101 of an antenna system 100 is fastened to the mounting bracket 400. The mounting bracket 400 is fastened to a generally vertically extending side pole 452 of the rear ladder of a recreational vehicle (RV). It is understood that mounting bracket 400 may be fastened to other types of vehicles, including trucks and boats, without departing from the scope of the invention. The enclosure 101 is further supported by the attached stabilizing bracket 406 bracing the mounting bracket 400 against the rear sidewall 454 of the RV.

The enclosure 101 may be fastened to a mounting bracket 400 at a point located vertically such that the protruding height of the enclosure 101 above the roof 456 of the vehicle is minimized. The ability to selectively adjust the mounting height allows the antenna enclosure 101 to maintain a low profile when mounted on the vehicle, while also allowing for unobstructed reception of incoming signals by the antenna. A low profile is advantageous because most relatively tall vehicles, such as RVs and over-the-road hauling trucks must be careful not to exceed certain height restrictions. By lowering the height of accessories such an antenna enclosure 100, the vehicle roof height can be maximized and/or aerodynamic drag reduced.

The mounting bracket 400 may be used as a convenient platform for operating the portable enclosed motorized antenna system while a vehicle is stationary or in-motion. The cabling or wires 458 extending from the enclosure can be neatly run along the roof 456 of the vehicle. Cable entry covers 460 can be used to neatly allow for a weather-tight entry into the vehicles interior where electrical components, such as controllers 462 and converters 464, are located. The configuration of the mounting bracket 400 also presents a central channel 466 (shown, for example, in FIGS. 21-22 and 26) through which cabling can be routed. Such routing makes for a neater installation and minimizes the potential for snagging the cables. In addition, the antenna system may be conveniently removed from the bracket and cabling without leaving unsecured cable that may be dangerous if the vehicle is operated with significant cable length left unsecured.

The mounting bracket 400 may be used to conveniently transport the portable enclosed motorized antenna system while the vehicle is traveling. For transport purposes, it is not necessary to provide cabling to the antenna enclosure 100. Using the mounting bracket as a means for transporting the antenna enclosure is convenient because it frees up space in storage compartments that would otherwise be consumed by storing the antenna enclosure.

The releasable aspect of the mounting bracket 400 permits a user to conveniently remove and reposition the portable enclosed antenna system in another location to avoid obstructions, such as trees at a campsite. Moreover, releasability permits a user to receive broadcast signals while in the vehicle and then remove the enclosure to use it for viewing in another location or application, for example on another vehicle, in a house, in a cabin or in a campground.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A lightweight motorized satellite television antenna system connectable to a separate receiver, the satellite television antenna system comprising:

a generally rigid enclosure comprising a cover and a base, the cover comprising an electromagnetic wave permeable material, the base defining a bottom side and an exterior perimeter, wherein the cover and base together define a fixed enclosed volume;

a generally circular parabolic reflector dish disposed inside of the fixed enclosed volume, the dish having a front side configured to reflect incoming satellite television signals in at least the Ku band, and an opposing back side;

a generally planar subreflector disposed inside of the fixed enclosed volume and located forward of the front side of the dish, the subreflector having a radius dimension;

a feed tube disposed between the subreflector and front side of the dish, the feed tube being circular in an axial cross-section and having a radius dimension smaller than the radius dimension of the subreflector;

a low noise block converter disposed inside of the fixed enclosed volume and located behind the back side of the satellite dish and configured to receive incoming satellite television signals in at least the Ku band via the feed tube;

an azimuth drive motor disposed completely inside of the fixed enclosed volume and configured to selectively adjust an azimuth orientation of the dish;

an elevation drive motor disposed completely inside of the fixed enclosed volume and configured to selectively adjust an elevation orientation of the dish; and an electronic aiming control system disposed inside of the fixed enclosed volume and connected to the azimuth drive motor and elevation drive motor to control automated aiming of the dish, the electronic aiming control system comprising a microprocessor, wherein the satellite antenna system is configured to be powered solely by the receiver though a single coaxial cable that spans between the satellite antenna system and the receiver.

2. The satellite television antenna system of claim 1, further comprising an external handle attached to the enclosure, the handle including a grasping portion, the grasping portion spaced away from the enclosure to define a gap such that a human hand can be inserted through the gap portion to grasp the grasping portion with one hand, wherein the lightweight motorized satellite television antenna system weighs at least 10 pounds and less than 15 pounds.

3. The satellite television antenna system of claim 1, wherein the electronic aiming control system is configured to automatically selectively actuate the elevation drive motor and azimuth drive motor to find and lock onto a correct satellite.

4. The satellite television antenna system of claim 1, wherein the enclosed volume is between 2600 and 3360 cubic inches.

5. The satellite television antenna system of claim 1 wherein all signals exchanged between the receiver and the satellite antenna system travel through the single coaxial cable.

6. The satellite television antenna system of claim 1, further comprising a plurality of feet protruding downwardly from the bottom side of the base such that the feet do not extend horizontally beyond the exterior perimeter of the base.

7. The satellite television antenna system of claim 1, wherein the electronic aiming control system is configured to automatically position the reflector dish and low noise block to acquire a signal upon powering on the satellite television antenna system.

8. The satellite television antenna system of claim 1, wherein control of the position of the dish is controlled automatically by interaction of the receiver with the electronic aiming control system, the electronic control system configured to selectively actuate the azimuth drive motor and the elevation drive motor in response to the interaction with the receiver.

9. A reduced volume motorized satellite television antenna system, comprising:

a radome and a base, wherein the radome and base define a volume; the antenna system having disposed within the volume: a dish antenna having a front side and a front surface area, and a back side, the front side being configured to reflect incoming satellite television signals in at least the Ku band; a feed tube and a subreflector each having a radius dimension, the feed tube having a radius dimension smaller than the radius dimension of the subreflector; a low noise block converter located on the back side of the satellite dish and configured to receive the incoming signals via the feed tube, an azimuth drive motor configured to selectively adjust an azimuth of the dish; an elevation drive motor configured to selectively adjust an elevation of the dish; and a microprocessor based aiming control system connected to the azimuth drive motor and elevation drive motor to control automated aiming of the dish;

wherein a reduced volume system is obtained by configuring the radome and the base to define an absolute value of the volume that is proportional to an absolute value of the dish antenna front surface area in a ratio of less 17:1 but greater than 14:1; and, wherein the reduced volume of the motorized satellite television antenna system results in a system weight of at least 10 pounds and less than 15 pounds.

10. The motorized satellite television antenna system of claim 9, wherein the antenna system comprises a height of no more than 17.5 inches.

11. The motorized satellite television antenna system of claim 9, wherein the antenna system comprises a width of at least 16 inches.

12. The satellite television antenna system of claim 9, further comprising an external handle attached to at least one of the radome and base, the handle configured to be grasped by a single human hand.

13. The satellite television antenna system of claim 9, wherein the microprocessor based aiming control system is configured to automatically selectively actuate the elevation drive motor and azimuth drive motor to find and lock onto a correct satellite.

14. The satellite television antenna system of claim 9, wherein the satellite television antenna system is configured to receive all power for operation from a satellite TV set top box connected to the satellite television antenna system via a single coaxial cable, the single coaxial cable also carrying all communications signals between the satellite television antenna system and the satellite TV set top box.

15. A single-hand transportable enclosed motorized satellite television antenna system, comprising:

a generally rigid enclosure comprising a cover and a base, the cover comprising an electromagnetic wave permeable material, the base defining a bottom side and an exterior perimeter, wherein the cover and base together define a fixed enclosed volume;

means for single-hand transport;

a parabolic reflector dish disposed completely inside of the fixed enclosed volume, the dish having a front side configured to reflect incoming satellite television signals in at least the Ku band, and an opposing back side;

a subreflector disposed completely inside of the fixed enclosed volume and located forward of the front side of the dish;

a feed tube disposed between the subreflector and front side of the dish;

a low noise block converter disposed completely inside of the fixed enclosed volume and located behind the back side of the satellite dish and configured to receive incoming satellite television signals in at least the Ku band;

an azimuth drive motor disposed completely inside of the fixed enclosed volume and configured to selectively adjust an azimuth orientation of the dish;

an elevation drive motor disposed completely inside of the fixed enclosed volume and configured to selectively adjust an elevation orientation of the dish; and an electronic control system disposed inside of the fixed enclosed volume and connected to the azimuth drive motor and elevation drive motor to control automated aiming of the dish, wherein the satellite television antenna system is configured to receive all power for operation from a satellite TV set top box connected to the satellite television antenna system via a single coaxial cable, the single coaxial cable also carrying all communications signals between the satellite television antenna system and the satellite TV set top box.

16. The satellite television antenna system of claim 15, wherein the means for single-hand transport comprises an external handle attached to the enclosure, the handle including a grasping portion, the grasping portion spaced away from the enclosure to define a gap such that a human hand can be inserted through the gap portion to grasp the grasping portion with one hand.

17. The satellite television antenna system of claim 15, wherein the electronic aiming control system is configured to automatically selectively actuate the elevation drive motor and azimuth drive motor to find and lock onto a correct satellite.

18. The satellite television antenna system of claim 15, wherein the satellite television antenna system weighs in the range of 10 to 20 pounds.

* * * * *